US012571221B2

(12) United States Patent
Fearn et al.

(10) Patent No.: US 12,571,221 B2
(45) Date of Patent: Mar. 10, 2026

(54) FORM SUPPORT AND LENGTH-ADJUSTABLE ASSEMBLY THEREFOR

(71) Applicant: Fab-Form Industries Ltd., Delta (CA)

(72) Inventors: Richard Neil Fearn, Delta (CA); Stephen Gabbott, Delta (CA)

(73) Assignee: FAB-FORM INDUSTRIES LTD., Delta (CA)

( * ) Notice: Subject to any disclaimer, the term of this patent is extended or adjusted under 35 U.S.C. 154(b) by 473 days.

(21) Appl. No.: 18/063,440

(22) Filed: Dec. 8, 2022

(65) Prior Publication Data

US 2024/0018792 A1 Jan. 18, 2024

Related U.S. Application Data

(60) Provisional application No. 63/424,448, filed on Nov. 10, 2022, provisional application No. 63/391,273, (Continued)

(51) Int. Cl.
*E04G 17/14* (2006.01)
*E04G 13/00* (2006.01)

(52) U.S. Cl.
CPC ..... *E04G 17/14* (2013.01); *E04G 13/00* (2013.01)

(58) Field of Classification Search
CPC ..... E04G 17/14; E04G 13/00
See application file for complete search history.

(56) References Cited

U.S. PATENT DOCUMENTS 821,738 A 5/1906 Pratt
849,922 A 4/1907 Scofield
(Continued)

FOREIGN PATENT DOCUMENTS

BE 838768 A 6/1976
CA 2036880 A1 8/1991
(Continued)

OTHER PUBLICATIONS

Archived Webpage of steelmate.com from Dec. 4, 2021 as found via WaybackMachine: https://web.archive.org/web/20211204070755/https://steelmate.com/.

(Continued)

*Primary Examiner* — Jessica L Laux
(74) *Attorney, Agent, or Firm* — Nicholas Garner; Oyen Wiggs Green & Mutala LLP

(57) ABSTRACT

There is provided a form support, a form assembly and a length-adjustable assembly therefor, as well as a method of installing a form assembly. The length-adjustable assembly includes upper and lower telescoping members and an end member removably coupled to and extending radially relative to the upper telescoping member. The length-adjustable assembly includes a male threaded member about which the telescoping members substantially extend. The male threaded member is rotatable relative to the end member with axial movement of the male threaded member relative to the end member being inhibited. The male threaded member threadably couples to a lower telescoping member.

The form support includes a mount coupled to and extending outwards from a lower end of and/or is adjacent the upper telescoping member according to one embodiment. The mount extends outwards from an upper end of the upper telescoping member in another embodiment. The mount may be L-shaped.

20 Claims, 23 Drawing Sheets

Related U.S. Application Data filed on Jul. 21, 2022, provisional application No. 63/388,798, filed on Jul. 13, 2022.

(56) References Cited

U.S. PATENT DOCUMENTS 1,008,210 A 11/1911 Skinner
1,509,835 A 9/1924 Grossenbach
1,510,950 A 10/1924 Markham
2,133,574 A 10/1938 Allen, V
2,505,426 A 4/1950 O'Flaherty
2,967,689 A 1/1961 Jahn
3,175,797 A 3/1965 Wells
3,393,489 A 7/1968 Oliver
3,396,545 A 8/1968 Lamberton
3,397,260 A 8/1968 Lamberton
3,397,494 A 8/1968 Waring
3,425,228 A 2/1969 Lamberton
3,429,548 A 2/1969 Taylor
3,471,987 A 10/1969 Yelsma
3,559,355 A 2/1971 Day, Jr.
3,561,175 A 2/1971 Best et al.
3,667,237 A 6/1972 Dougan
3,673,750 A 7/1972 Bokvist et al.
3,688,457 A 9/1972 Sherno
3,694,989 A 10/1972 Oliver et al.
3,708,146 A 1/1973 Lamberton
3,715,851 A 2/1973 Bennett
3,719,341 A 3/1973 Harrington
3,797,800 A 3/1974 Loy
3,956,859 A 5/1976 Ingestrom
4,003,546 A 1/1977 Johnson
4,054,259 A 10/1977 Johnson
4,065,893 A 1/1978 Epes
4,066,237 A 1/1978 Bentz
4,133,930 A 1/1979 Wright et al.
4,154,061 A 5/1979 Umemoto et al.
4,198,798 A * 4/1980 Haydock ..... E04B 1/4164 52/704
4,199,909 A 4/1980 Kotcharian
4,270,583 A 6/1981 Tolliver
4,304,388 A 12/1981 Gates
4,366,657 A 1/1983 Hopman
4,397,441 A 8/1983 Manderla
4,463,538 A 8/1984 Dragunas
4,476,074 A 10/1984 Bindhoff
4,489,528 A 12/1984 Tolliver
4,600,459 A 7/1986 Proctor
4,643,388 A 2/1987 Tazawa
4,689,926 A 9/1987 McDonald
4,711,058 A 12/1987 Patton
4,790,509 A 12/1988 Cardwell et al.
4,799,348 A 1/1989 Brami et al.
4,813,200 A 3/1989 Kirchner
4,833,857 A 5/1989 Wheeler
4,854,542 A 8/1989 Pruett
4,965,978 A 10/1990 Scheiwiller
4,983,077 A 1/1991 Sorge et al.
5,000,621 A 3/1991 Beamer
5,205,942 A 4/1993 Fitzgerald
5,224,321 A 7/1993 Fearn
5,328,142 A 7/1994 Weekers
5,343,667 A * 9/1994 Peden ..... E04G 17/12 52/127.2
5,347,787 A 9/1994 Gavin
5,368,269 A 11/1994 Boisseau
5,376,316 A 12/1994 Weekers
5,398,472 A 3/1995 Eichelkraut
5,459,971 A 10/1995 Sparkman
5,495,696 A 3/1996 Repka
5,538,361 A 7/1996 Beamer
5,542,229 A 8/1996 Saito et al.
5,564,235 A 10/1996 Butler
5,580,480 A 12/1996 Chatelain
5,593,623 A 1/1997 Mohss
5,611,183 A 3/1997 Kim
5,653,078 A 8/1997 Kies et al.
5,658,483 A 8/1997 Boeshart
5,664,377 A 9/1997 Angelo et al.
5,671,574 A 9/1997 Long
5,687,522 A 11/1997 Durand et al.
5,794,387 A 8/1998 Crookham
5,794,393 A 8/1998 Fearn
5,817,247 A * 10/1998 Colatruglio ..... E01C 19/502 249/207
5,836,126 A 11/1998 Harkenrider et al.
5,857,293 A 1/1999 Redjvani
5,896,714 A 4/1999 Cymbala et al.
6,076,320 A 6/2000 Butler
6,112,489 A 9/2000 Zweig
6,120,723 A 9/2000 Butler
6,158,710 A 12/2000 Matthews
6,216,403 B1 4/2001 Belbeoc
6,231,024 B1 5/2001 Kugimiya et al.
6,234,447 B1 5/2001 Boyden et al.
6,238,144 B1 5/2001 Babcock
6,240,700 B1 6/2001 Sheu
6,254,056 B1 7/2001 Alfred
6,341,453 B1 1/2002 Cholley
6,343,894 B1 * 2/2002 Fearn ..... E04G 17/12 249/168
6,367,214 B1 4/2002 Monachino
6,367,764 B1 * 4/2002 Butler ..... E02D 27/00 411/397
6,438,918 B2 8/2002 Moore, Jr. et al.
6,453,627 B1 * 9/2002 Powers ..... E04B 1/34342 52/745.1
6,492,012 B1 12/2002 Shah
6,550,213 B1 4/2003 Butler
6,568,141 B2 5/2003 Kremers
6,691,486 B1 2/2004 Durand
6,698,710 B1 3/2004 VanderWerf
6,718,716 B2 4/2004 Cowie
6,832,454 B1 12/2004 Iyer
6,837,017 B2 1/2005 Hardy, Jr. et al.
6,964,141 B2 11/2005 Igarashi
7,086,801 B2 8/2006 Swahn et al.
7,226,033 B2 6/2007 Foucher et al.
7,451,579 B2 11/2008 Azarin
7,549,263 B1 6/2009 Porter
8,011,158 B1 9/2011 Powell
8,202,033 B2 6/2012 Choi et al.
8,286,398 B2 10/2012 Fearn
9,045,912 B2 6/2015 Fearn
9,109,874 B2 8/2015 Simmons et al.
9,347,232 B1 * 5/2016 Francies, III ..... E04B 5/04
9,359,012 B2 * 6/2016 Yao ..... F16B 37/042
D885,172 S * 5/2020 Lowrie ..... D8/384
10,688,683 B2 6/2020 Giles
10,914,072 B2 2/2021 Paulger
11,584,624 B1 2/2023 Christensen
2001/0004819 A1 6/2001 Reymann
2001/0029717 A1 10/2001 Spakousky
2002/0139073 A1 10/2002 Morello
2003/0029130 A1 * 2/2003 Humphrey ..... E04G 21/185 52/764
2003/0033760 A1 2/2003 Rogers et al.
2003/0168575 A1 9/2003 Fearn et al.
2004/0128922 A1 7/2004 Fearn
2007/0044405 A1 3/2007 Straub et al.
2007/0056226 A1 3/2007 Angelo
2007/0056227 A1 3/2007 Angelo
2007/0068100 A1 3/2007 Fearn
2007/0200048 A1 8/2007 Edwards, Jr. et al.
2007/0294970 A1 12/2007 Marshall et al.
2007/0295873 A1 12/2007 Schulze
2008/0083190 A1 4/2008 Fearn
2009/0100784 A1 4/2009 Garza et al.
2009/0272873 A1 11/2009 Fittler et al.
2009/0313914 A1 12/2009 Kovatch et al.
2010/0031587 A1 2/2010 Weeks
2011/0214376 A1 9/2011 Jaycock
2021/0180628 A1 6/2021 Yoen et al.

(56) References Cited

U.S. PATENT DOCUMENTS

| | | | |
|---|---|---|---|
| 2021/0404128 | A1 | 12/2021 | Reitano et al. |
| 2022/0162868 | A1 | 5/2022 | Hiller et al. |

FOREIGN PATENT DOCUMENTS

| | | | |
|---|---|---|---|
| CA | 2090074 | A1 | 8/1993 |
| CA | 2505683 | A1 | 10/2006 |
| CN | 106088481 | A | 11/2016 |
| CN | 107675836 | A | 2/2018 |
| CN | 108560835 | A | 9/2018 |
| CN | 108756077 | A | 11/2018 |
| CN | 210177809 | U | 3/2020 |
| CN | 210766771 | U | 6/2020 |
| CN | 112049329 | A | 12/2020 |
| CN | 215330949 | U | 12/2021 |
| CN | 117166516 | A | 12/2023 |
| CN | 221001673 | U | 5/2024 |
| DE | 2062998 | A1 | 7/1972 |
| DE | 2345173 | A1 | 3/1975 |
| DE | 2849300 | A1 | 5/1980 |
| DE | 9200496 | U1 | 3/1992 |
| EP | 0608068 | A1 | 7/1994 |
| FR | 2271356 | B1 | 9/1977 |
| FR | 2531470 | B1 | 7/1985 |
| FR | 2610339 | B1 | 6/1991 |
| GB | 828415 | A | 2/1960 |
| GB | 949352 | A | 2/1964 |
| GB | 2310875 | A | 9/1997 |
| JP | S57140429 | A | 8/1982 |
| WO | 1992014886 | A1 | 9/1992 |
| WO | 1997034099 | A2 | 9/1997 |
| WO | 2006125837 | A1 | 11/2006 |
| WO | 2017061882 | A1 | 4/2017 |

OTHER PUBLICATIONS https://www.grabbbarr.com/pages/products/grabbbarr, Web page print-out as of Jun. 25, 2024.

https://www.instagram.com/reel/C77mjsZNmhM/?igsh=M3hhNmt5dHFqOWYx, Web page prinout as of Jun. 25, 2024.

International Search Report for Application PCT/CA98/00619 dated Oct. 7, 1998.

"What is fabric forming?" dated Sep. 2, 2011 as found on the WayBackMachine™: https://web.archive.org/web/20110902002652/http:/www.fabricforming.org/technical_overview.html.

* cited by examiner

FORM SUPPORT AND LENGTH-ADJUSTABLE ASSEMBLY THEREFOR

CROSS REFERENCE TO RELATED APPLICATIONS

This application is a non-provisional of i) U.S. Provisional Patent Application No. 63/388,798 filed in the United States Patent and Trademark Office on 13 Jul. 2022, and the disclosure of which is incorporated herein by reference and priority to which is claimed; ii) U.S. Provisional Patent Application No. 63/391,273 filed in the United States Patent and Trademark Office on 21 Jul. 2022, and the disclosure of which is incorporated herein by reference and priority to which is claimed; and iii) U.S. Provisional Patent Application No. 63/424,448 filed in the United States Patent and Trademark Office on 10 Nov. 2022 and the disclosure of which is incorporated herein by reference and priority to which is claimed.

BACKGROUND OF THE INVENTION

Field of the Invention

There is a form support. In particular, there is provided a form support for use in forming concrete foundations, together with a length-adjustable assembly therefor.

Description of the Related Art

With footing construction in northern climates, after site excavation, two footing forms (typically using 2×8 or 2×10 lumber) are typically nailed together on the ground using slats (e.g. 1×4 lumber), thereby forming a ladder. The ladder is then positioned in the X-Y directions according to the desired dimensions of the building to be constructed. The contractor then drives stakes on either side of the ladder around the perimeter of the building footprint. Using a laser, the contractor then lifts the ladder up to the correct elevation and nails the stakes to the footing forms. Note that the correct height of the footing ladder may be critical as this determines the height of the building foundation itself. Concrete is next poured into the ladder so positioned to form the footing and/or building foundation.

There may be several problems with the above method. It may be difficult to nail the stakes to the footing forms at the correct height. One or more stakes may sink into the ground during the nailing process. In this case the nails must be removed and the nailing at the correct height repeated once more. During the construction of the footing forms, various stakes may settle in the ground, requiring a re-leveling of the footing ladder. Footing forms may be heavy and difficult to lift. Finally, during the pouring of concrete, the elevation of the footing ladder may settle and this may be very difficult to correct when the ladder is full of concrete.

Poured concrete foundations for buildings involving both footing and wall components have been used for many years and usually require disposable formwork such as lengths of lumber and plywood sheets, which are temporarily installed on the ground or site surfaces in two stages. First the footing forms are installed by driving pairs of stakes in the ground at about eight feet on center, and then nailing pairs of dimensional lumber (e.g. two pieces of 2×10 lumber) to the stakes in a horizontal position to form the footing. This process may time consuming and labor intensive, and often the soil may render driving stakes therein difficult. A concrete pump and truck may be needed to fill up the footing forms, and labor may be required to screed the top of the concrete to make it level. Lumber and stakes may then be removed the following day, requiring more labor and considerable time. Damaged lumber must then be disposed of which may increase waste at landfills. The above set out levelling challenges may also exist.

Wall forms are next set up on top of the poured footing, braced, and filled with concrete. The concrete pump may be required a second time which adds greatly to the expense of the foundation. Both types of foundation formwork described above use lengths of lumber and plywood sheets which, after stripping from the set concrete, are contaminated with concrete and thus are usually unsuitable for use elsewhere in the building, except perhaps in low-grade or temporary construction work. Consequently, when constructing conventional concrete foundation forms, there is usually a high labor input both in installing the forms and stripping the forms after pouring the concrete, and there is also high wastage of form material when the poured foundation has been stripped.

U.S. Pat. No. 6,343,894 to Fearn discloses building foundation form apparatus and methods related to the same. This includes transverse form supports supported directly on the ground and carrying longitudinal form supports adjustably located on opposite sides of, and substantially parallel to, a foundation axis. A flexible sheet form element has edge portions connected to the longitudinal form supports and a contact portion located between the edge portions and supported on the ground and deformed into a general U-shape with overhanging bulges to receive the flowable and settable foundation mixture. The longitudinal form supports are adjustable vertically to accommodate ground undulations to ensure correct footing width. The contact portion has mesh opening to pass the foundation mixture therethrough to enhance adhesion to the ground. The sheet form element has marginal portions extending upwardly from the contact portion to the bulges, the marginal portions having mesh openings which pass concrete mixture to fill voids beneath the overhanging bulges.

United States Patent Application Publication No. 2022/0162868 A1 to Hiller et al. discloses a brace for supporting a concrete form. The brace includes a strongback couplable to an insulated concrete form, a platform coupled to the strongback, and an outrigger. The brace includes an adjustment mechanism having a casing portion coupled to the platform, a manipulable body housed within the casing portion, and a retaining body housed within the casing. The manipulable body extends through an opening of the casing portion and is coupled to the outrigger. The adjustment mechanism is manipulable by a single user located on the platform to reposition the outrigger to adjust a plumb of the concrete form.

BRIEF SUMMARY OF INVENTION

There is provided, and it is an object to provide, an improved form support and length-adjustable assembly therefore disclosed herein.

There is accordingly provided a length-adjustable assembly according to one aspect. The length-adjustable assembly includes a pair of telescoping members. The length-adjustable assembly includes an end member removably coupled to and extending radially relative to a first said telescoping member. The length-adjustable assembly includes a male threaded member about which one or more of the telescoping members substantially extend. The male threaded member is rotatable relative to the end member with axial/longitudinal movement of the male threaded member relative to the end member being inhibited. The male threaded member threadably couples to a second said telescoping member.

There is further provided a form support according to one aspect. The form support comprises the above set-out length-adjustable assembly.

There is also provided a form support according to another aspect. The form support includes upper and lower telescoping members. The form support includes a length-adjustable assembly with actuation thereof enabling positioning of the upper telescoping member relative to the lower telescoping member to be adjusted. The form support includes a mount coupled to and extending outwards from a lower end of the upper telescoping member.

There is further provided a form support according to an additional aspect. The form support includes upper and lower telescoping members. The form support includes a length-adjustable assembly with actuation thereof enabling positioning of the upper telescoping member relative to the lower telescoping member to be adjusted. The form support includes a mount coupled to, extending outwards from, and adjacent the upper telescoping member.

There is yet also provided a form support according a further aspect. The form support includes upper and lower telescoping members. The form support includes a length-adjustable assembly with actuation thereof enabling positioning of the upper telescoping member relative to the lower telescoping member to be adjusted. The form support includes a form support coupled to and extending outwards from the upper telescoping member. The form support is L-shaped in top and side profile.

There is also provided a form support according to yet another aspect. The form support includes upper and lower telescoping members. The form support includes a length-adjustable assembly with actuation thereof enabling positioning of the upper telescoping member relative to the lower telescoping member to be adjusted. The form support includes a mount coupled to and extending outwards from the upper telescoping member between lower and upper ends of the upper telescoping member.

There is further provided a form support according to an additional aspect. The form support includes upper and lower telescoping members. The form support includes a length-adjustable assembly with actuation thereof enabling positioning of the upper telescoping member relative to the lower telescoping member to be adjusted. The form support includes a form support coupled to and extending outwards from the upper telescoping member. The form support includes a baseplate coupled to the lower telescoping member. The baseplate has a plurality of apertures extending therethrough of different diameters.

There is yet further provided a form support according another aspect. The form support includes upper and lower telescoping members. The form support includes a length-adjustable assembly with actuation thereof enabling positioning of the upper telescoping member relative to the lower telescoping member to be adjusted. The form support includes a vertically-extending L-shaped bracket coupled to and extending outwards from the upper telescoping member.

There is yet also provided a form support according to an additional aspect. The form support includes upper and lower telescoping members. The form support includes a length-adjustable assembly with actuation thereof enabling positioning of the upper telescoping member relative to the lower telescoping member to be adjusted. The form support includes a first L-shaped bracket coupled to and extending outwards from the upper telescoping member. The form support includes a second L-shaped bracket coupled to a lower end of the lower telescoping member.

There is additionally provided a form support according to another aspect. The form support includes upper and lower telescoping members. The form support includes a length-adjustable assembly. Actuation of the length-adjustable assembly enables positioning of the upper telescoping member relative to the lower telescoping member to be adjusted. The form support includes a mount integrally connected to the upper telescoping member so as to form a unitary whole.

It is emphasized that the invention relates to all combinations of the above features, even if these are recited in different claims.

Further aspects and example embodiments are illustrated in the accompanying drawings and/or described in the following description.

BRIEF DESCRIPTION OF DRAWINGS

The accompanying drawings illustrate non-limiting example embodiments of the invention.

DESCRIPTION OF THE PREFERRED EMBODIMENTS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
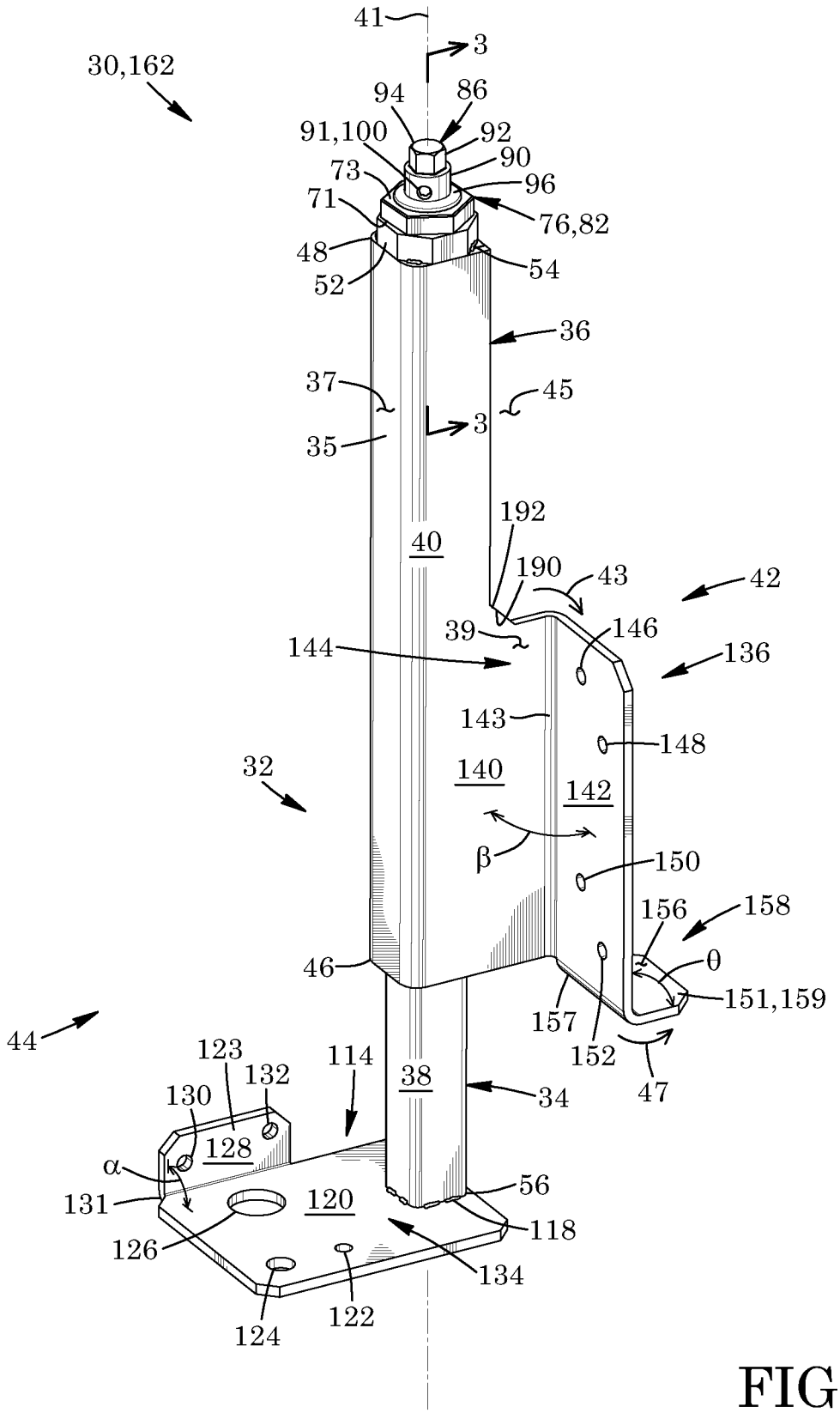
FIG. 1 is a front, top, outer side perspective view of a form support according to a first aspect.

Referring to the drawings and first to FIG. 1, there is shown a form support 30. The form support may be referred to as an adjustable side support or a transverse form. Form support 30 is configured to selectively elevate and/or level a form within which concrete is poured, such as in one non-limiting embodiment a lumber ladder as will be discussed in more detail below.

The form support includes a length-adjustable assembly 32. The length-adjustable assembly includes upper and lower portions, in this example in the form of a pair of or first and second telescoping members, in this case first and second legs, in this instance inner leg 34 and outer leg 36. The inner leg may be referred to as an inside leg and the outer leg may be referred to as an outside leg.

Figure 2:
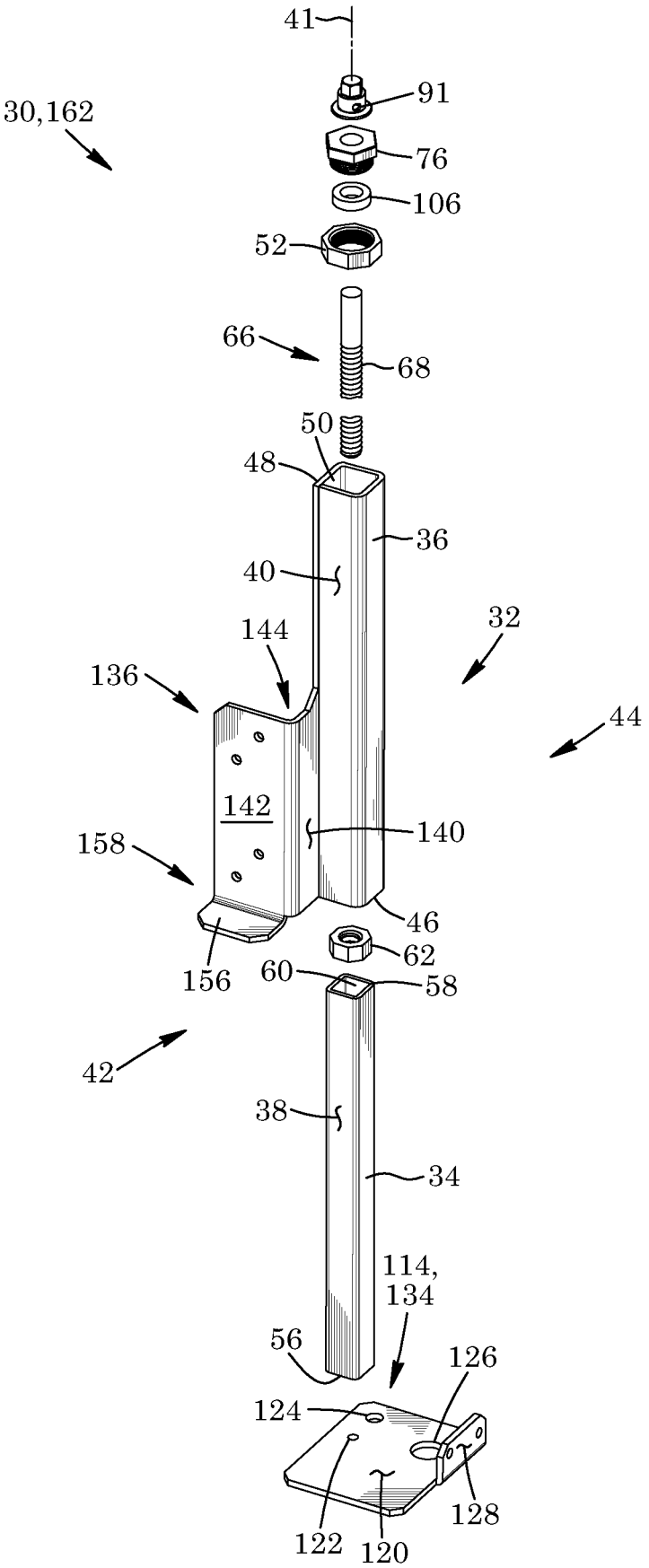
FIG. 2 is a fully exploded, rear, top, inner side perspective view thereof.
Figure 3:
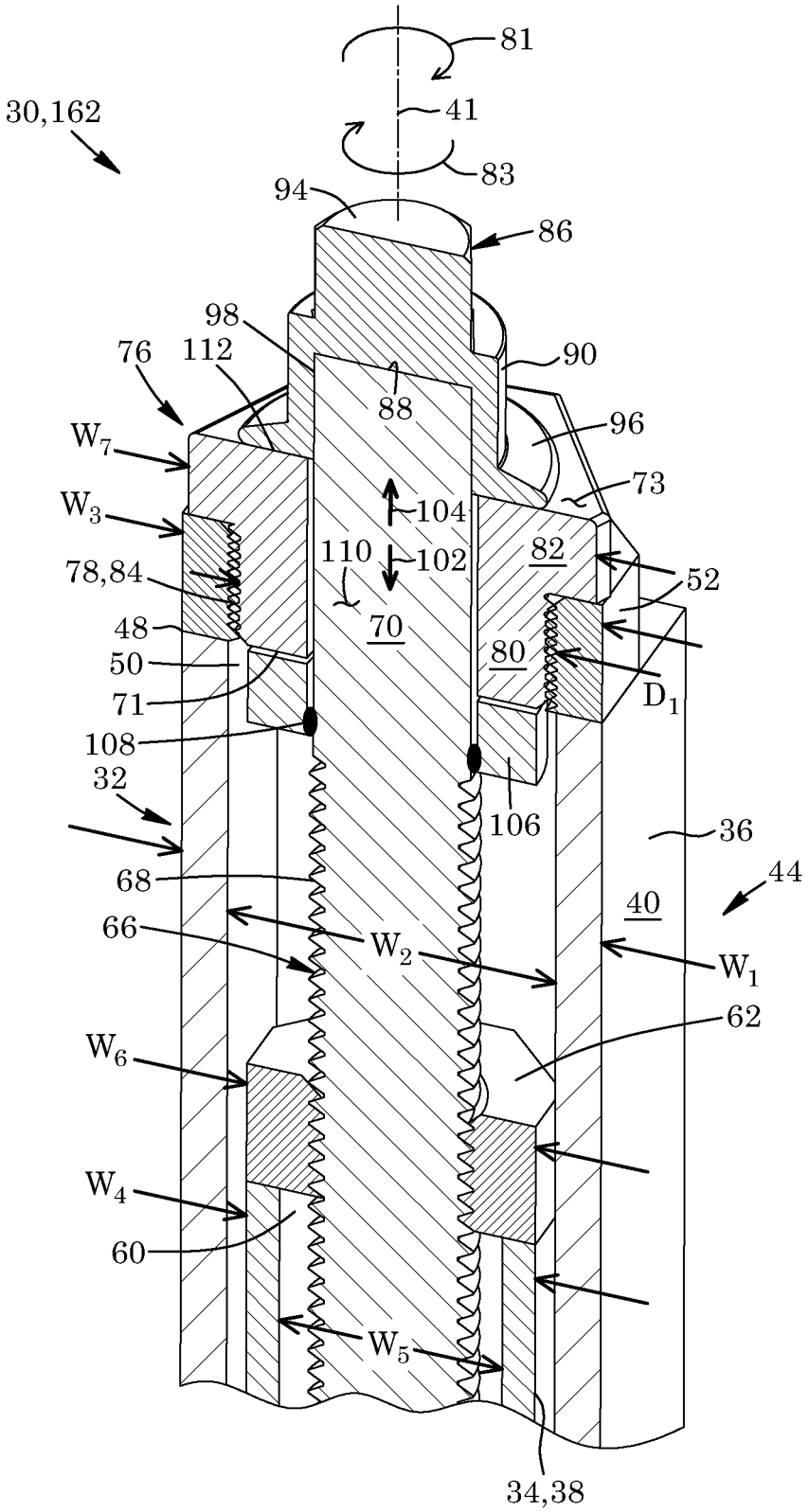
FIG. 3 is a sectional view taken along lines 3-3 of the form support of FIG. 1, the form support being shown in fragment.

As seen in FIG. 2, legs 34 and 36 in this non-limiting embodiment comprise elongate conduits, in this example tubes 38 and 40. Each tube is a square or rectangular in lateral section in this example; however this is not strictly required. As seen in FIG. 1, length-adjustable assembly 32 has a longitudinal axis 41 about which and along which tubes 38 and 40 extend. Legs 34 and 36 collectively have a first side 42 and a second side 44 opposite the first side thereof. As seen in FIG. 2, outer leg 36 has a first or lower end 46, a second or upper end 48 spaced-apart from the lower end thereof and an upper opening adjacent the upper end thereof. As seen in FIG. 3, the outer leg has an outer width $W_1$ and an inner width $W_2$.

Still referring to FIG. 3, length-adjustable assembly 32 includes a first female threaded member 52 in this non-limiting example coupled to upper end 48 of outer leg 36. However, this is not strictly required and the first female threaded member need not couple to the upper end of the outer leg in other embodiments and/or may be integrally formed with the outer leg in other embodiments for example. First female threaded member 52 is in this non-limiting example welded via welding 54 seen in FIG. 2A to upper end 48 of outer leg 36. The first female threaded member is a nut in this example; however, this is not strictly required. First female threaded member 52 is polygonal in outer shape, in this example octagonal in outer shape. As seen in FIG. 3, the first female threaded member is shaped to span, be larger than and thus cover at least in part upper opening 50 of outer leg 36. First female threaded member 52 has a width $W_3$ equal to outer width $W_1$ of outer leg 36 in this example; however this is not strictly required.

As seen in FIG. 2, inner leg 34 has a first or lower end 56 and a second or upper end 58 spaced-apart from the lower end thereof. The inner leg has an upper opening adjacent the upper end thereof. As seen in FIG. 3, inner leg 34 has an outer width $W_4$ and an inner width $W_5$.

Figure 2A:
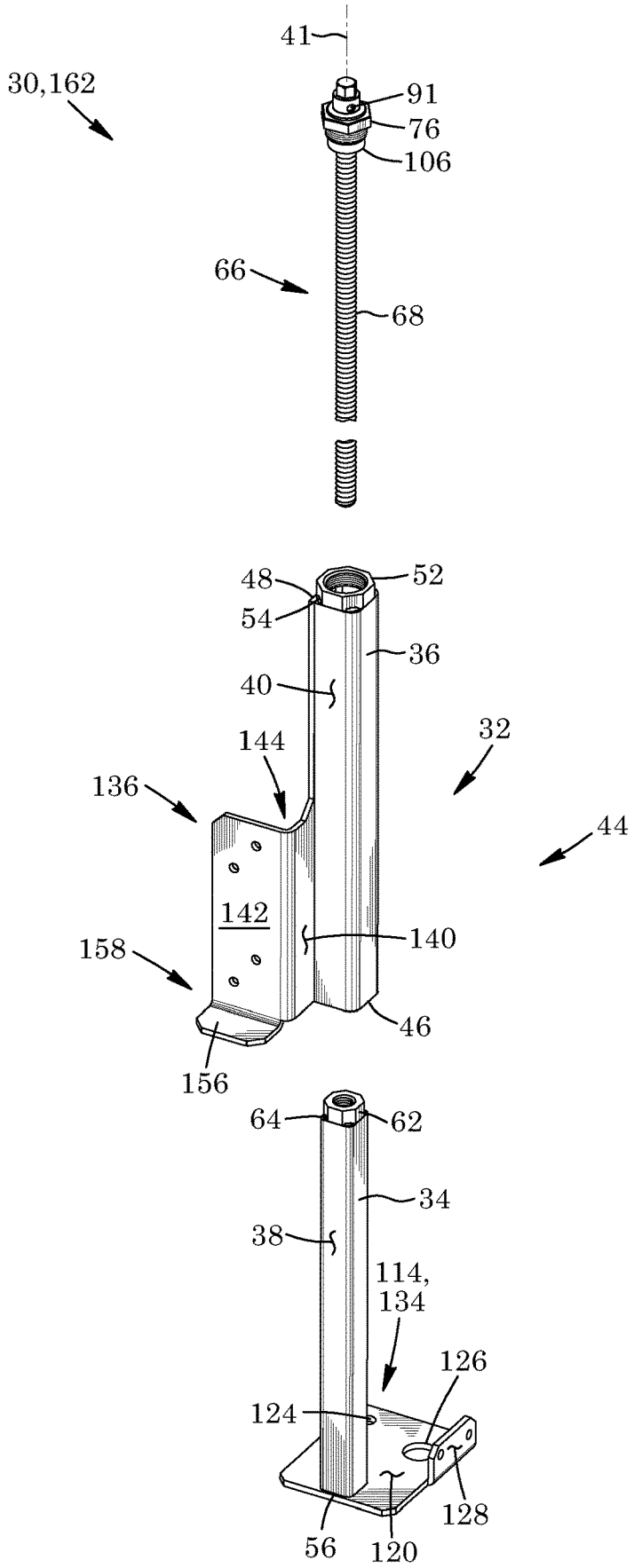
FIG. 2A is a partially exploded, rear, top, inner side perspective view thereof.

Still referring to FIG. 3, length-adjustable assembly 32 includes a second female threaded member 62 in this example coupled to upper end 58 of inner leg 34. However, this is not strictly required and the second female threaded member need not couple to the upper end of the inner leg in other embodiments and/or may be integrally formed with the inner leg in other embodiments for example. As seen in FIG. 2A, second female threaded member 62 is welded to upper end 58 of inner leg 34 via welding 64 in this example. The second female threaded member is a nut in this example; however, this is not strictly required. Second female threaded member 62 is polygonal in outer shape, in this example octagonal in outer shape. Referring to FIG. 3, the second female threaded member is shaped to span, be larger than and thus cover at least in part upper opening 60 of inner leg 34. Second female threaded member 62 has a width $W_6$ equal to outer width $W_4$ of the inner leg in this example; however, this is not strictly required.

As seen in FIG. 2, length-adjustable assembly 32 includes a male threaded member, in this example a threaded shaft 66. The threaded shaft includes a first of right-hand and left-hand threading, in this example right hand threading 68. As seen in FIG. 3, upper end portion 70 of threaded shaft 66 is non-threaded in this example. Legs 34 and 36 substantially extend about the threaded shaft, in this example extending about and enclosing threading 68. Inner leg 34 and/or outer leg 36 may thus be referred to as thread protecting sleeves.

Threaded shaft 66 operatively connects to outer leg 36 and threadably connects to inner leg 34. The threaded shaft threadably couples to the inner leg via second female threaded member 62 in this example. Form support 30 has a retracted position seen in FIG. 7 in which in this non-limiting embodiment lower end 46 of outer leg 36 aligns with and is adjacent lower end 56 of inner leg 34. Threaded shaft 66 seen in FIG. 3 operatively connects to the legs such that selective actuation length-adjustable assembly 32 causes the legs to be moveable from the retracted position seen in FIG. 7 and as seen by arrow 72, to an extended position seen in FIG. 8 so as to span an adjustment length L. The adjustment length may be up to 10 inches or more in one non-limiting embodiment.

Figure 7:
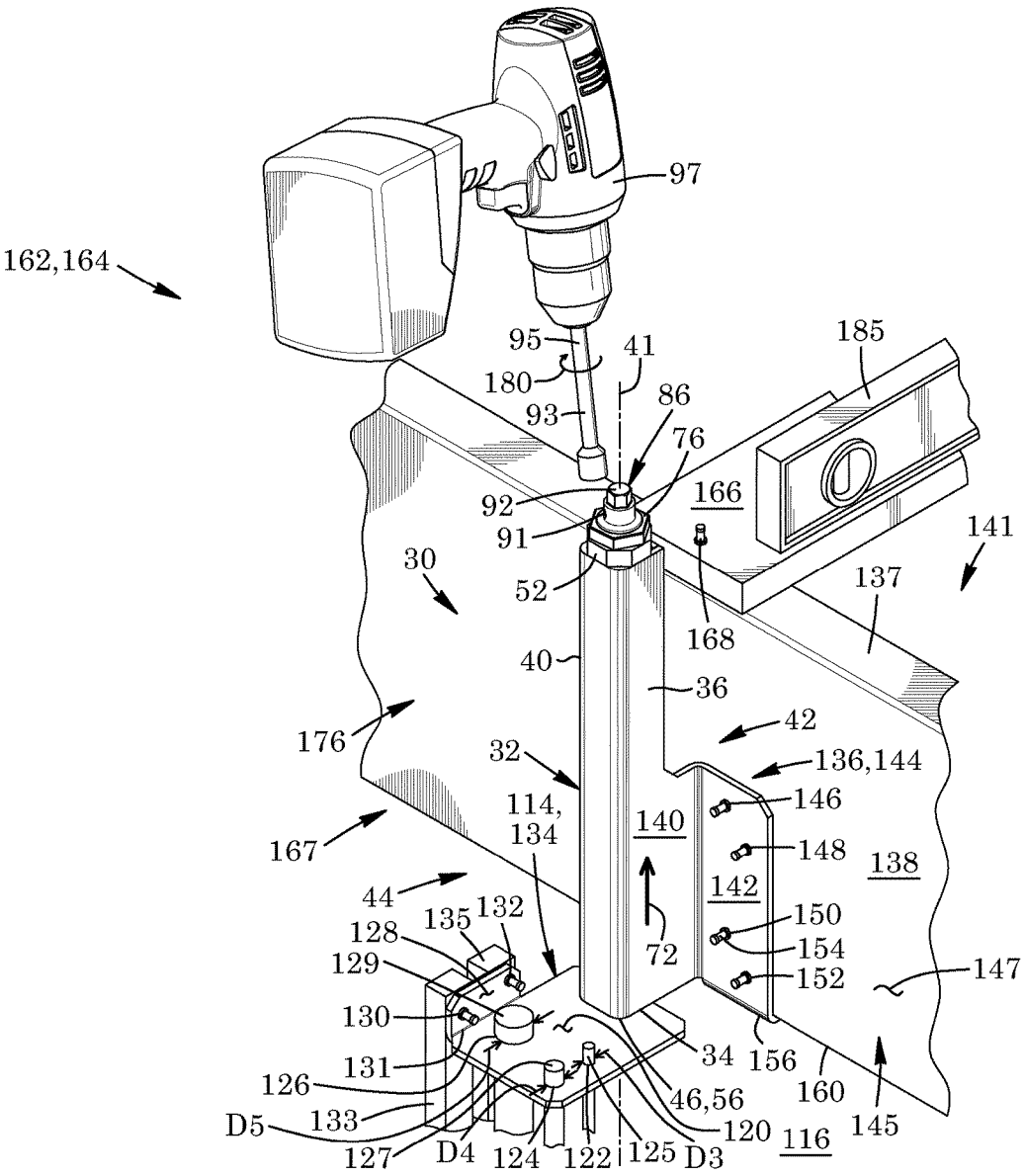
FIG. 7 is a front, top, side perspective view of one of the form supports of FIG. 6 shown coupled to a respective outer footing board of FIG. 6, with the footing board being shown in fragment and the form support being shown in a retracted position.
Figure 8:
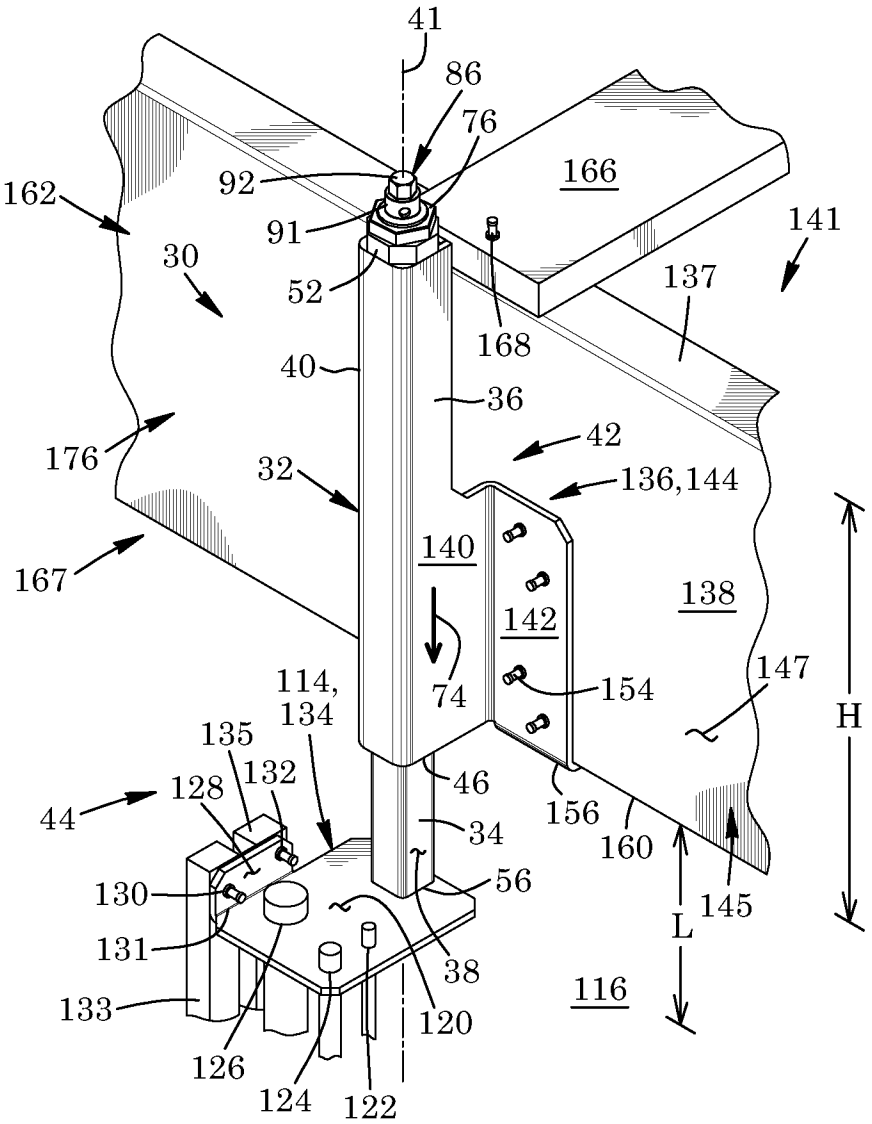
FIG. 8 is a front, top, side perspective view of the form support of FIG. 7 shown coupled to the respective outer footing board of FIG. 7, with the footing board being shown in fragment, the form support being shown in an extended position and with the footing board being selectively elevated thereby.

Lower end 46 of outer leg 36 is longitudinally spaced-apart from lower end 56 of inner leg 34 in the extended position of form support 30 seen in FIG. 8. Form support 30 is selectively moveable from the extended position and as seen by arrow 74, towards the retracted position seen in FIG. 7 once more by following the above steps in reverse. As seen in FIG. 3, inner leg 34 may thus be said to have a nut or female threaded member 62 coupled to top or upper end 58 thereof to raise and lower form support 30.

Still referring to FIG. 3, length-adjustable assembly 32 includes an end member 76. The end member extends radially relative outer leg 36 and longitudinal axis 41 of the length-adjustable assembly. End member 76 is configured to enable threaded shaft 66 to removably couple to outer leg 36. The end member and threaded shaft are configured such that the threaded shaft is freely rotatable relative to the end member with axial/longitudinal movement of the threaded shaft relative to the end member being inhibited.

The following is a non-limiting configuration of threaded shaft 66 and end member 76 that enables the above functionality.

Still referring to FIG. 3, end member 76 in this example extends about upper end portion 70 of the threaded shaft. The end member has a downwardly-facing bottom 71 and an upwardly-facing top 73 spaced-apart from the bottom thereof. End member 76 in this non-limiting example includes an inner portion 80 and an outer portion 82 coupled to and extending radially outwards from the inner portion thereof. End member 76 is T-shaped in longitudinal section in this example, though this is not strictly required. Inner portion 80 and outer portion 82 of end member 76 are integrally connected together so as to form a unitary whole. Inner portion 80 is generally annular in shape in this example.

End member 76 threadably couples to outer leg 36 in this example; however, this is not strictly required and the end member may removable couple to the outer leg in other manners in other embodiments. The end member threadably couples to the outer leg via a second of right-hand and left-hand threading, in this example left-hand or reverse threading 78. The reverse threading extends about an exterior or outer surface 84 of inner portion 80 of end member 76. The inner portion of the end member threadably couples to outer leg 36 via first female threaded member 52 in this example; however, this is not strictly required and the inner portion of the end member may threadably couple directly to the outer leg in other embodiments. Inner portion 80 of end member 76 threadably couples to the outer leg via the first female threaded member by rotating the inner portion of the end member in a first direction of rotation, in this example a counter-clockwise direction of rotation 81. End member 76 thus threadably couples to outer leg 36 in this example first female threaded member. Inner portion 80 of the end member has an outer diameter $D_1$ substantially equal to inner width $W_2$ of outer leg 36 in this example; however this is not strictly required.

Outer portion 82 of end member 76 has a width $W_7$ greater than the outer diameter $D_1$ of inner portion 80 of the end member in this example. The outer portion of the end member is substantially equal to outer width $W_1$ of outer leg 36 as well as outer width $W_3$ of first female threaded member 52 in this example. Outer portion 82 of end member 76 is shaped to span upper opening 50 of outer leg 36. The outer portion of the end member is shaped to span and abut the first female threaded member when inner portion 80 of the end member is fully threadably coupled to the first female threaded member. Outer portion 82 of end member 76 is polygonal in outer shape, in this non-limiting embodiment hexagonal in outer shape.

Still referring to FIG. 3, length-adjustable assembly 32 includes a first protrusion coupled to and extending radially-outwards from threaded shaft 66, in this example in the form of an end portion or end cap 86 coupled to the threaded shaft. However, this is not strictly required and the first protrusion may be integrally connected to the threaded shaft so as to form a unitary whole in other embodiments for example. End cap 86 is enlarged. The end cap is annular at least in part in this non-limiting example. End cap 86 couples to and extends radially-outwards from upper end 88 of threaded shaft 66 in this example. The end cap extends axially/longitudinally outwards from the threaded shaft in this example.

End cap 86 includes a body 90. The body of the end cap is outwardly cylindrical in shape in this example. As seen in FIG. 1, body 90 of end cap 86 has a laterally-extending aperture 91 extending therein. The laterally-extending aperture is shaped to receive either i) welding (seen by weld 100) therethrough to couple the end cap to threaded shaft 66 or ii) an elongate member, such as the elongate shaft of a screw driver (not shown) therethrough, thereby facilitating selective rotation of the end cap in a first manner. Referring to FIG. 3, end cap 86 includes a drill-bit engageable end 92 along a top 94 thereof. Threaded shaft 66 couples to and thus effectively includes the drill-bit engageable end. Drill-bit engageable end 92 of end cap 86 as herein described may be referred to as an end portion of the end cap. The drill-bit engageable end of the end cap is a polygonal-shaped head, in this case a hexagonal-shaped head in this non-limiting embodiment. Drill-bit engageable end 92 of end cap 86 is radially inwardly spaced relative to body 90 of the end cap in this example. Referring to FIG. 7, the drill-bit engageable end of the end cap is shaped to be received by a drill bit 93 on a driver 95 of a power tool, in this example an electric drill 97. This thereby enables selective rotation of the end cap in a second manner. Driver 95 may be a 7/16 inch driver in one non-limiting example, though this is not strictly required.

Referring back to FIG. 3, end cap 86 in this example includes a radially outwardly extending protrusion configured to inhibit axial/longitudinal movement of the threaded shaft relative to end member 76 in a first or downward direction 102. The following is a non-limiting embodiment of a configuration/protrusion that provides the above functionality.

The protrusion in this non-limiting example is in the form of a first stop or flange 96 positioned along a bottom 99 thereof. The flange is annular in this example; however, this is not strictly required and, instead of a flange, the protrusion may be elongate for example. Body 90 of end cap 86 extends between flange 96 and drill-bit engageable end 92 of the end cap. The flange is shaped to extend along and be slidable relative to top 73 of end member 76. End cap 86 thus abuts and is rotatable relative to the end member.

The end cap couples to threaded shaft 66. In this non-limiting example end cap 86 has a longitudinally-extending bore 98 shaped to receive upper end portion 70 of the threaded shaft. The end cap couples to threaded shaft 66 thereby, either through pressing fitting, frictional interference, mechanical coupling, welding for example as shown by welds 100 inserted within aperture 91 to couple with the threaded shaft seen in FIG. 1, or other such manner of connection. As a further non-exhaustive alternative and referring to FIG. 3, end cap 86 may include interior threading in communication with bore 98, with upper end portion 70 of threaded shaft 66 extending within the bore and threadably coupling to the end cap. In this case, the end cap or drill-bit engageable end 92 thereof as herein described may be referred to as an adjuster nut attached to the threaded shaft. Flange 96 of end cap 86 so coupled to threaded shaft 66 is shaped to abut end member 76 and thus inhibit axial/longitudinal movement of the threaded shaft relative to the end member in downward direction 102.

As seen in FIG. 3, length-adjustable assembly 32 in this non-limiting embodiment may also include a second protrusion configured to inhibit axial movement of the threaded shaft relative to the end member in a second or upward direction 104; however, this is not strictly required and no second protrusion is provided in other embodiments. The following is a non-limiting embodiment of a configuration/protrusion that provides the above functionality.

The second protrusion in this example couples to and extends radially-outwards from threaded shaft 66 and is in this example a second stop or collar 106. The collar is annular in this non-limiting example; however, the protrusion need not be annular or a collar and may be elongate in other embodiments. As a further variation, the second protrusion may be integrally connected to threaded shaft 66 so as to form a unitary whole, with end cap 86 being selectively connectable to the threaded shaft for example. As an additional variation, the second protrusion may couple to and extend radially-inwards from inner leg 34 and/or be integrally formed with and extend radially inwards from the inner leg so as to form a shoulder or stop, for example.

Collar 106 is axially/longitudinally spaced from end cap 86. The collar in this example couples to upper end portion 70 of threaded shaft 66, in this case via welding as shown by welds 108; however, this is not strictly required. Collar 106 is annular in this example, though as discussed above if the collar is a stop in another form this is not strictly required and may comprise a knob or other protrusion in other embodiments. The collar is radially inwardly spaced relative to end member 76 in this example. The end member is positioned between flange 96 of end cap 86 and collar 106. Collar 106 has an outer diameter D2 which is less than inner width $W_2$ of outer leg 36 in this example.

The flange of the end cap, the collar and a portion 110 of threaded shaft extending therebetween form an annular space 112 within which end member 76 is received and is moveable relative thereto. Collar 106 selectively abuts and is rotatable relative to bottom 71 of the end member. The collar is shaped to abut end member 76 and inhibit axial/longitudinal movement of threaded shaft 66 relative to the end member in upward direction 104. Flange 96 and collar 106 thus function as stops that abut the end member and inhibit axial/longitudinal movement of the threaded shaft relative to the end member.

Referring to FIG. 3, there may thus be provided a method of forming length-adjustable assembly 32, with the method including positioning end member 76 such that top 73 thereof abuts or is adjacent a first protrusion of (or coupled to) threaded shaft 66, in this case flange 96 in this non-limiting embodiment. The method may next include positioning a second protrusion below or adjacent bottom 71 of the end member such that the end member is rotatable relative to the protrusions. The method includes coupling the second protrusion to one of threaded shaft 66 and outer leg 36, with the second protrusion in this non-limiting embodiment comprising collar 106 welded to the threaded shaft.

Selective unthreading of end member 76 in a second direction of rotation, in this example a clockwise direction of rotation 83, enables threaded shaft 66, together with end cap 86 and collar 106 coupled thereto, to be removed.

Referring to FIG. 1, form support 30 includes a base member 114 configured to abut ground 116. The base member is shaped to enable length-adjustable assembly 32 to be freestanding. Base member 114 couples to inner leg 34, in this example via welding as shown by welds 118. The base member extends outwards from second side 44 of legs 34 and 36. Base member 114 includes a first planar portion, in this example a first baseplate 120. The first baseplate couples to lower end 56 of inner leg 34. First baseplate 120 extends laterally outwards from the lower end of the inner leg. The first baseplate is rectangular with ends or corners that are beveled or sloped in this non-limiting embodiment. First baseplate 120 extends horizontally in use in this example.

The first baseplate has a plurality of holes or apertures extending therethrough, in this example apertures 122, 124 and 126. Each of the apertures has a different diameter in this example, with aperture 124 being larger than aperture 122 and aperture 126 being larger than aperture 124. The apertures are shaped to receive one or more positioning/fastening members therethrough, in this example stakes 125, 127 and 129 seen in FIGS. 7 and 8. The stakes have different diameters $D_3$, $D_4$ and $D_5$. Base member 114 so configured, with apertures 122, 124 and 126 thereof, is thus shaped to accommodate stakes of different sizes. Stakes 125, 127 and 129 are used to couple form support 30 to ground 116 in an upright or vertically-extending position.

As seen in FIG. 1, base member 114 includes a second planar portion, in this example a second baseplate 128. The second baseplate couples to and is angled relative to first baseplate 120 by angle α. Second baseplate 128 extends perpendicular to the first baseplate in this example, with angle α substantially equalling to 90 degrees; however this is not strictly required. The second baseplate is integrally connected to first baseplate 120 so as to form a unitary whole in this example; however, here too this is not strictly required. Second baseplate 128 is formed in this non-limiting embodiment by bending a projecting portion or tab 123 of the first baseplate upwards towards a perpendicular position relative to the rest of the first baseplate. A bent portion 131 extends horizontally first baseplate 120 and second baseplate 128. The second baseplate may thus be referred to as a bent-up edge or portion or tab of base member 114 in this example. Baseplates 120 and 128 form a first L-shaped bracket 134 in this example. The first L-shaped bracket as herein described may be referred to a horizontally-extending L-shaped bracket.

Second baseplate 128 is spaced-apart from inner leg 34 via first baseplate 120. The second baseplate extends substantially vertically in use in this example. Second baseplate 128 is rectangular with upper ends or corners that are beveled or sloped in this non-limiting embodiment. The second baseplate has one or more apertures extending therethrough, in this example a pair of horizontally and vertically offset apertures 130 and 132. One or more additional positioning/fastening members, in this example additional stakes 133 and 135 seen in FIGS. 7 and 8 may couple to second baseplate via fasteners, in this example duplex screws or nails 149 extending through apertures 130 and 132 and coupling thereto. The stakes may be wooden 1×4 stakes, though this is not strictly required. Second baseplate 128 may facilitate securing form support 30 to sandy soil via stakes 133 and 135 in this example. The stakes thus function to further couple the form support to ground 116 in its upright or vertically-extending position.

As seen in FIG. 1, form support 30 includes a mount 136. The mount couples to and extends outwards from outer leg 36. Mount 136 extends outwards from first side 42 of legs 34 and 36. The mount is configured to be adjacent outer leg 36 in this embodiment. Base member 114 is shaped to counterbalance the moment caused by mount 136, enabling form support 30 to be freestanding thereby. The mount is adjacent lower end 56 of outer leg 36. Mount 136 extends from the lower end towards upper end 48 of the outer leg. The mount in this embodiment is shaped to selectively couple to and receive a form member, in this example a planar form, in this case one of footing boards 138 and 139 seen in FIG. 6. Each footing board as herein described may be referred to as a form board. Footing boards 138 and 139 may comprise lumber in one non-limiting embodiment. Referring to FIG. 1, mount 136 may thus individually be referred to as a support for lumber. Each of footing boards 138 and 139 is a rectangular prism in shape in this example.

The following is a non-limiting embodiment of the mount. Mount 136 includes a first planar member, in this example a first plate 140. The first plate couples to and extends outwards from outer leg 36. First plate 140 couples to and is integrally formed with tube 40 of the outer leg in this example so as to form a unitary whole; however, this is not strictly required. Second baseplate 128 of base member 114 extends parallel to first plate 140 of mount 136 in this example.

The mount includes a second plate 142. The second plate couples to and is angled relative to first plate 140 of the mount by angle β. Second plate 142 as herein described may be referred to as a flange. The second plate extends perpendicular to the first plate of the mount in this example, with angle R substantially equalling to 90 degrees; however this is not strictly required. Second plate 142 is integrally connected to first plate 140 so as to form a unitary whole in this example. The second plate is formed in this non-limiting embodiment by bending a projecting portion or tab 151 of the first plate towards a perpendicular position relative to the rest of the first plate. A bent portion 143 of mount 136 extends vertically between plates 140 and 142.

The second plate of the mount is spaced from outer leg 36 via the first plate of the mount. First and second plates 140 and 142 of mount 136 extend parallel to longitudinal axis 41 and outer leg 36 in this example. The first and second plates of the mount extend vertically in use in this example. First and second plates 140 and 142 of mount 136 form in this example a second L-shaped bracket 144. The second L-shaped bracket as herein described may be referred to a vertically-extending L-shaped bracket. First and second plates 140 and 142 of mount 136 are substantially similar in size in this non-limiting embodiment.

As seen in FIG. 1, the second plate of mount 136 has one or more apertures extending therethrough: in this non-limiting embodiment a first pair laterally and longitudinally spaced apart apertures 146 and 148 and a second pair laterally and longitudinally spaced apart apertures 150 and 152. As seen in FIG. 7, second plate 142 is shaped to abut and extend along an outer side 145 and an outer side portion, in this example an outer lower side portion 147 of footing board 138.

Referring to FIG. 1, the method of forming form support 30, or outer leg 36 thereof, may thus further comprise bending a first longitudinal portion 35 of a blank 37 about itself to form the outer leg. The method may next include shaping a second longitudinal portion 39 of the blank so as to form mount 136, with the mount extending outwards from the outer leg and being angled at least in part. The method may include bending the second longitudinal portion of blank 37 in a first direction 43 so as to form second plate 142 bent relative to first plate 140. The method may include removing one of an upper or lower portion of second longitudinal portion 39 of the blank, in this embodiment upper portion 45.

As seen in FIG. 1, mount 136 in this non-limiting embodiment includes a third plate 156; however, this is not strictly required and the mount may not include a third plate in other embodiments. The third plate couples and is angled relative to second plate 142 of the mount by angle θ. Third plate 156 extends perpendicular to second plate 142 in this example, with angle θ substantially equalling to 90 degrees; however this is not strictly required. The third plate is integrally connected to the second plate so as to form a unitary whole in this example. Third plate 156 is formed in this non-limiting embodiment by bending a projecting portion or tab 159 of second plate 142 towards a horizontal position. A bent portion 157 of mount 136 extends horizontally between the second and third plate. The mount, including plates 140, 142 and 156 thereof, in this non-limiting embodiment is integrally connected to and formed with outer leg 36 so as to form a unitary whole. The method of forming form support 30, or outer leg 36 thereof, may thus include bending protruding projecting portion or tab 159 of second longitudinal portion 39 of the blank in a second direction 47 orthogonal to first direction 43, so as to form third plate 156 bent relative to second plate 142.

The third plate of mount 136 extends horizontally in use in this example. First baseplate 120 of base member 114 extends parallel to the third plate of the mount in this non-limiting embodiment. As seen in FIG. 1, first plate 140 of mount 136 is orthogonal to second plate 142 and third plate 156 of the mount in this example. The second plate of the mount is orthogonal to the third plate of the mount in this non-limiting embodiment. Mount 136 is thus L-shaped in top and side profile in this example. Second and third plates 142 and 156 of the mount form a third L-shaped bracket 158. The third L-shaped bracket as herein described may be referred to a horizontally-extending L-shaped bracket. Plates 140, 142 and 156 are rectangular in profile in this non-limiting embodiment; however, this is not strictly required. As seen in FIG. 2, the second and third plates have outer ends or corners that are beveled or sloped in this non-limiting embodiment.

As seen in FIG. 8, third plate 156 of mount 136 in this non-limiting embodiment aligns with and extends parallel to lower end 46 of outer leg 36. The third plate as herein described may be referred to as a bottom edge or edge portion of the mount. As seen in FIG. 7, third plate 156 of mount 136 in this non-limiting embodiment aligns with and extends parallel to lower end 56 of inner leg 34 when form support 30 is in its retracted position. The third plate of the mount is shaped to support footing board 138. Third plate 156 in this example is shaped to abut and receive at least in part a lower portion or bottom 160 of the footing board. At least one and in this example each of apertures 146, 148, 150 and 152 of second plate 142 is shaped to one or more fasteners, in this example duplex screws or nails 154 therethrough to selectively couple mount 136 to outer lower side portion 147 of footing board 138. The apertures thus enable selective attachment of the lumber to form support 30. In one non-limiting embodiment, duplex nails are 1½ inches in length, though this is not strictly required. Duplex nails or fasteners may facilitate selective removal thereof when concrete poured into the form has been set and footing boards 138 and the like are no longer required. However, in each instance of the specification where duplex nails or fasteners are referenced, such fasteners are not strictly required and other types of fasteners may be used in other embodiments.

As seen in FIG. 1, mount 136 in this non-limiting example includes a brace 190, though this is not strictly required. The brace is shaped to support plates 140 and 142 and inhibit movement of the plates. Brace 190 couples to and extends between first plate 140 and outer leg 36 in this example. The brace is in this example in the form of a fourth or triangular plate 192. The triangular plate is integrally connected to and formed with first plate 140 and outer leg 36 so as to form a unitary whole in this non-limiting embodiment. Brace 190 is upwardly facing in this example.

Referring to FIGS. 4 to 7, a non-limiting method of using form support 30 and/or length-adjustable assembly 32 thereof, as well a non-limiting example of a form assembly 162 that includes the same, will now be described.

Figure 4:
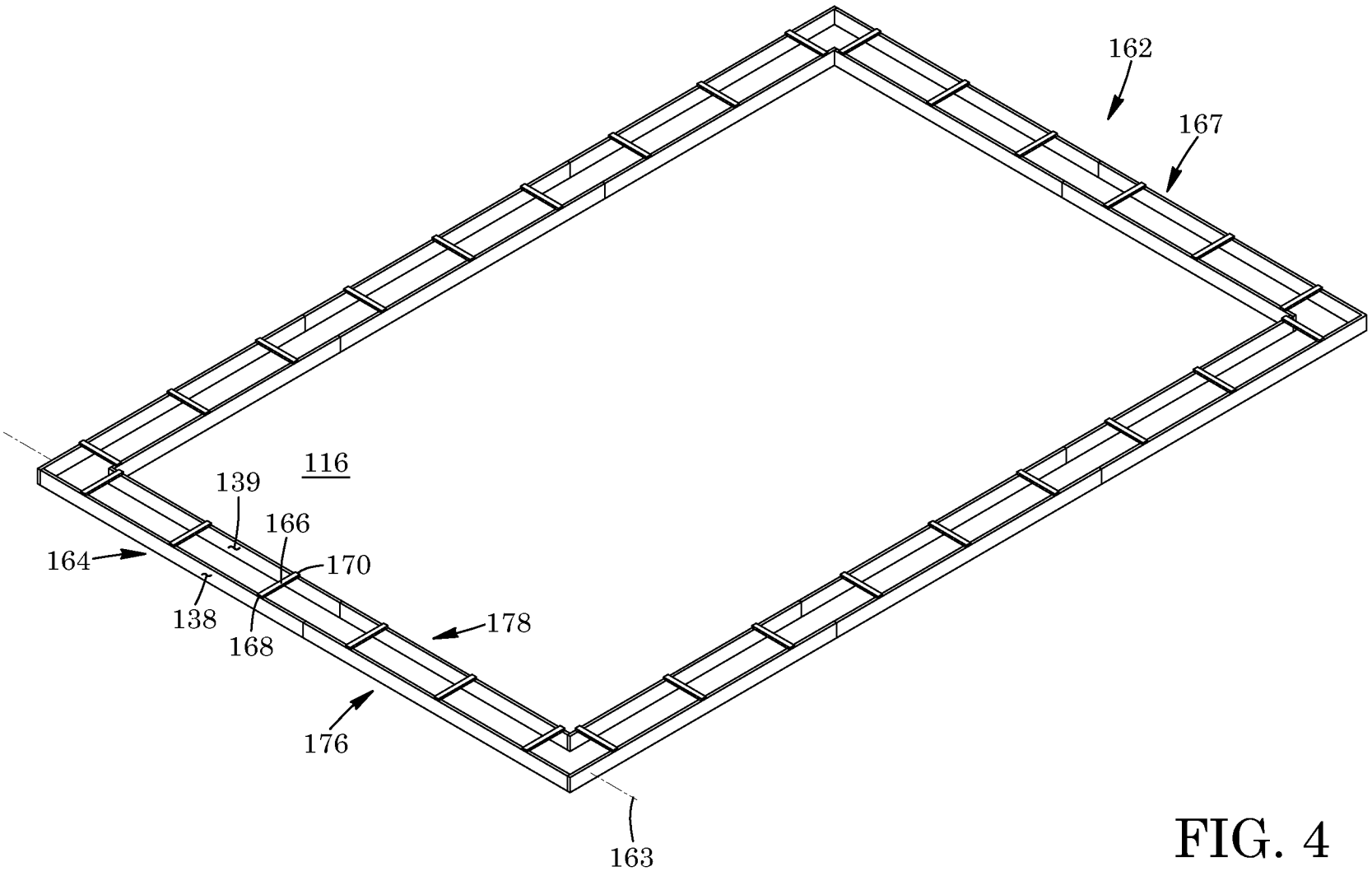
FIG. 4 is a front, top, side perspective view of a form assembly according to one aspect, the form assembly comprising coupled together inner and outer footing boards between which concrete is to be poured to form a footing of a foundation.

As seen in FIG. 4, the method of installing the form assembly may including levelling ground 116 so that the ground is substantially level or flat within a predetermined threshold.

Form assembly 162 in this non-limiting embodiment comprises ladders 164 built using pairs of longitudinally-extending members or footing boards 138 and 139. The footing boards may in one non-limiting example comprise 2×8s or 2×10s of lumber which are approximately 16 feet in length and which are spaced-apart by a footing width of approximately 24 inches for example. Form assembly 162 has one or more longitudinal portions 161, each extending along a respective longitudinal axis 163. For each longitudinal portion of the form assembly, corresponding footing boards 138 and 139 are arranged to extend parallel to and on either side of the longitudinal axis thereof.

Each ladder 164 includes longitudinally spaced-apart and laterally-extending members, in this example crosspieces 166. The crosspieces may in this non-limiting embodiment comprise 1×4s of lumber that are approximately 27 inches in length. Crosspieces 166 are configured to join footing boards 138 and 139 together: in this example the crosspieces couple to tops 137 of the footing boards via fasteners, in this case, duplex nails 168 and 170. Adjacent crosspieces are longitudinally spaced apart relative to their corresponding footing boards. In this non-limiting example crosspieces 166 are longitudinally spaced-apart by approximately 5' 4" on center around perimeter 167 of the foundation, though this is not strictly required. The method of installing form assembly 162 may thus comprise coupling together a pair of longitudinally-extending footing boards 138 and 139 via one or more crosspieces 166. The footing boards so coupled together via the crosspieces, enclose a space 169 and comprise a footing form 141.

Figure 5:
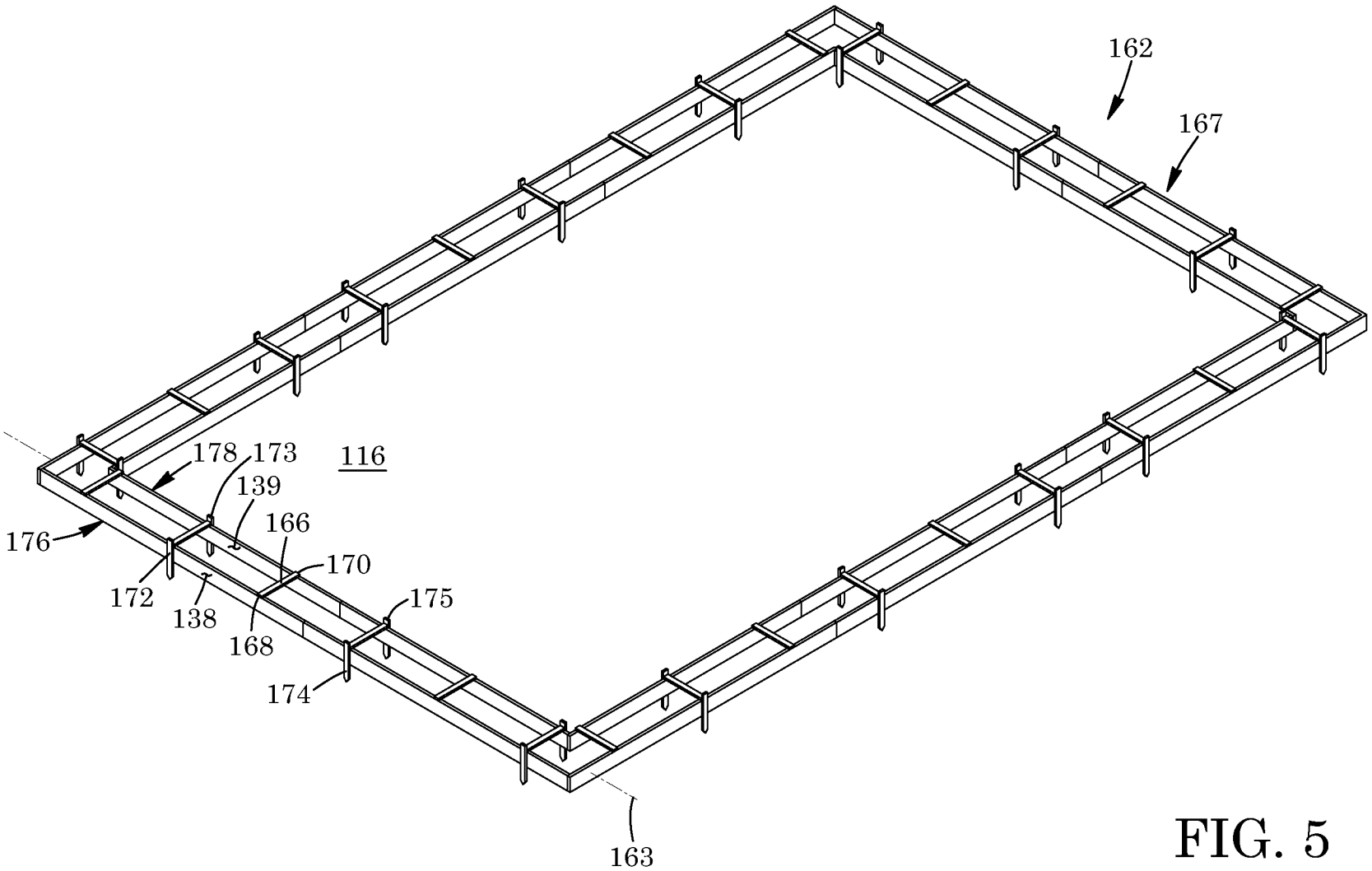
FIG. 5 is a front, top, side perspective view of the form assembly of FIG. 4, with the form assembly including a plurality of coupled-together pairs of stakes longitudinally spaced-apart and driven into the ground and abutting respective ones of the inner and outer footing boards.

Referring now to FIG. 5, form assembly 162 includes longitudinally spaced pairs of retaining members or stakes 172/173 and 174/175. The stakes are next driven into ground 116 on opposite outer and inner sides 176 and 178 of ladder 164. Stakes 172/173 and 174/175 are positioned around perimeter 167 of the form assembly 162 so as to abut respective footing boards 138 and 139. The stakes in one non-limiting embodiment may be made of metal or comprise 1×4s of lumber, depending on ground conditions. Pairs of stakes 172/173 and 174/175 are positioned adjacent every second crosspiece 166 in this example. The stakes hold footing boards 138 and 139 in the correct X-Y position on the jobsite. Stakes 172/173 and 174/175 are not fastened or nailed to ladder 164 until leveling of the footing boards has been completed. The method of installing form assembly 162 may thus comprise installing a plurality of longitudinally spaced pairs of stakes 172/173 and 174/175 adjacent respective ones of footing boards 138 and 139 so as to promote correct positioning of the footing boards.

Figure 6:
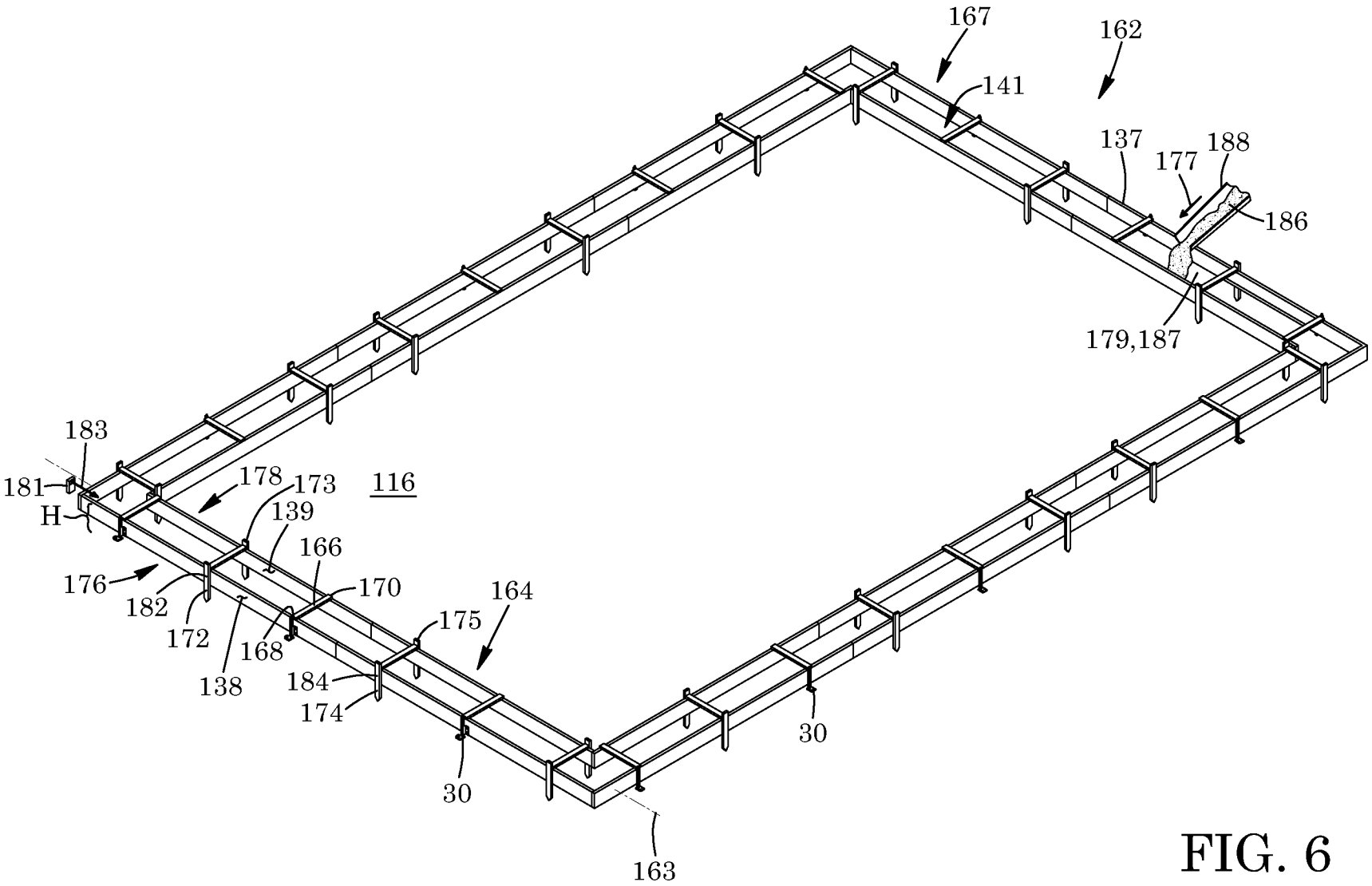
FIG. 6 is a front, top, side perspective view of the staked form assembly of FIG. 5, with the form assembly including with a plurality of pairs of form supports according to FIG. 1, with the pairs of form supports being longitudinally spaced-apart and positioned to support bottoms of respective ones of the inner and outer footing boards, with concrete also being shown in the process of being poured into the form assembly via a concrete chute shown in fragment.

As seen in FIG. 6, form assembly 162 for each ladder 164 includes one or more pairs of form supports 30 extending outer side 176 and inner side 178 of the ladder. In this example the pairs of form supports are longitudinally spaced-apart along respective ones of the footing boards 138 and 139. However, this is not strictly required and pairs of aligned form supports on the outer and inner sides of the footing boards are not strictly required and adjacent form supports may be staggered with respect to each other in other embodiments. In this non-limiting example, each pair of form supports 30 couples to its footing boards halfway between successive pairs of stakes 172/173 and 174/175. The method of installing form assembly 162 may thus comprise aligning one or more form supports on opposite sides 176 and 178 of footing boards 138 and 139. The method of installing the form assembly may include aligning one or more form supports 30 on opposite sides of footing boards 138 and 139 such that second plate 142 of mount 136 of the form support abuts lower side portion 147 of its corresponding footing board and third plate 156 of the mount of the form support receives and abuts bottom 160 of its corresponding footing board seen in FIG. 7.

Still referring to FIG. 7, the second plate of the mount of the form support selectively couples to its respective footing board 138, in this example via fasteners, in this non-limiting case duplex nails 154. The method of installing form assembly 162 may thus comprise selectively coupling one or more form supports 30 to opposite sides of the footing boards. The method of installing the form assembly may thus comprise selectively coupling second plate 142 of mount 136 of form support 30 to an outer side 176 of a respective footing board 138 via removable fasteners. The form support is installed in its retracted position in this example, though this is not strictly required.

Still referring to FIG. 7, form support 30 is next length or height adjusted to the correct or desired elevation. This adjustment occurs in this example by coupling drill bit 93 of driver 95 to drill-bit engageable end 92 of the form support and selectively actuating electric drill 97 thereafter as shown by direction of rotation 180. Referring to FIG. 6, a first height alignment device, in this example a laser 181 may be used to get the exact height H, though this is not strictly required. The method of installing form assembly 162 may thus comprise selectively adjusting the length or height of footing boards 138 and 139 by selectively rotating threaded shaft 66 seen in FIG. 3 via a power tool or electric drill 97 seen in FIG. 7 until the footing boards are at a substantially correct or desired elevation. The method of installing the form assembly may include using laser 181 seen in FIG. 6 to delineate the correct or desired elevation and adjusting the footing boards to substantially align with a beam of light 183 emitted by the laser. As seen in FIG. 7, a second height alignment device, in this example a level 185 may extend along one or more crosspieces 166 to ensure that footing board 138 is substantially level with its corresponding/parallel footing board 139 seen in FIG. 6.

Still referring to FIG. 6, stakes 172/173 and 174/175 are next coupled to footing boards 138 and 139 so height adjusted via fasteners, in this non-limiting example duplex nails 182 and 184. This may inhibit laterally-outward spreading of the footing boards and ensure that the elevation of the footing boards is substantially correct. Laser 181 seen in FIG. 6 may be used once more thereafter to ensure height H of footing boards 138 and 139 relative to ground 116 is correct. The method of installing form assembly 162 may thus comprise selectively coupling one or more stakes 172/173 and 174/175 to the footing boards so height adjusted via fasteners, in this non-limiting example duplex nails 182 and 184. The method of installing the form assembly may include using laser 181 to ensure thereafter that height H of footing boards 138 and 139 remains at substantially correct after nailing off the stakes. This method may include emitting beam of light 183 via the laser and determining whether the footing boards so positioned substantially align with the beam of light.

Still referring to FIG. 6, concrete 186 is next poured in direction 177 via in this example concrete chute 188 into footing form 141 so elevated so as to form a footing 187. The concrete may be screeded to tops 137 of footing boards 138 and 139. Form supports 30, footing boards 138 and 139, crosspieces 166 and stakes 172/173, 174/175 may thereafter be removed after the concrete has set and a threshold period of time, such as the next day in one non-limiting example. The method of installing form assembly 162 may be part of a method of forming a footing 187 for a foundation 179, with the method including pouring concrete into the enclosure or footing form 141 built by coupled-together footing boards so height-adjusted.

Form support 30, and/or length-adjustable assembly 32 thereof, may thus comprise an alternative apparatus and method for leveling up lumber forms for above grade footings. Form assembly 162 may thus comprise drill adjustable side supports to lift up lumber ladder 164.

Referring to FIG. 8, in addition or alternatively, form assembly 162 may also include a longitudinally-extending fabric element 189, such as that shown in FIG. 17 or 29, with peripheral portions 191 and 193 of the fabric element being shaped to couple to_footing boards 138 (either on the inside or outside thereof) so as to form an upwardly-facing channel 195 below the footing boards and within which concrete may be also poured to form footing 187 of foundation 179. A non-limiting example of the fabric element is FastFoot®, a high density polyethylene fabric which may be purchased at Fab-Form Industries Ltd., having an address of 1610 Derwent Way #19, Delta, BC, V3M 6W1, Canada. More details for this product are found via the link https://www.fab-form.com/fastfoot/fastfootOverview.php, the disclosure of which is incorporated herein by reference.

Many advantages result from form assembly 162, form support 30 and length-adjustable assembly 32 thereof. For example and referring to FIG. 7, the form support and length-adjustable assembly thereof may enable the contractor to quickly adjust the precise height or level of footing board 138 using electric drill 97 in a manner that protects the length-adjustable assembly on the one hand (threading 68 of threaded shaft 66 seen in FIG. 3 for height-adjustment are located inside legs 34 and 36 so that concrete cannot damage them), while enabling the length-adjustable assembly to be selectively disassembled, inspected, maintained and the like on the other hand. Form support 30 as herein described is reusable and repairable. The form support and length-adjustable assembly as herein described may also enable the footing boards seen in FIG. 7 to be height adjusted at any point in the building process.

Mount 136 so shaped and configured may be readily removed or easily stripped from the poured footing by removing duplex nails 154 from second plate 142. Referring to FIG. 1, legs 34 and 36, mount 136 and base member 114 may also each be made of sheet metal and cut and formed with a minimal number of manufacturing steps. This may result in form support 30 and length-adjustable assembly 32 thereof, which are both robust and cost-effective. The form support and/or length-adjustable assembly may thus be referred to as a sheet metal lumber holder in this non-limiting embodiment.

FIGS. 9 to 17 show a form assembly 162.1 and form support 30.1 thereof according to another aspect. Like parts have like numbers and functions as form assembly 162 and form support 30 thereof shown in FIGS. 1 to 8 with the addition of decimal extension "0.1". Form assembly 162.1 and form support 30.1 are substantially the same as form assembly 162 and form support 30 shown in FIGS. 1 to 8 with at least the following exceptions.

Figure 9:
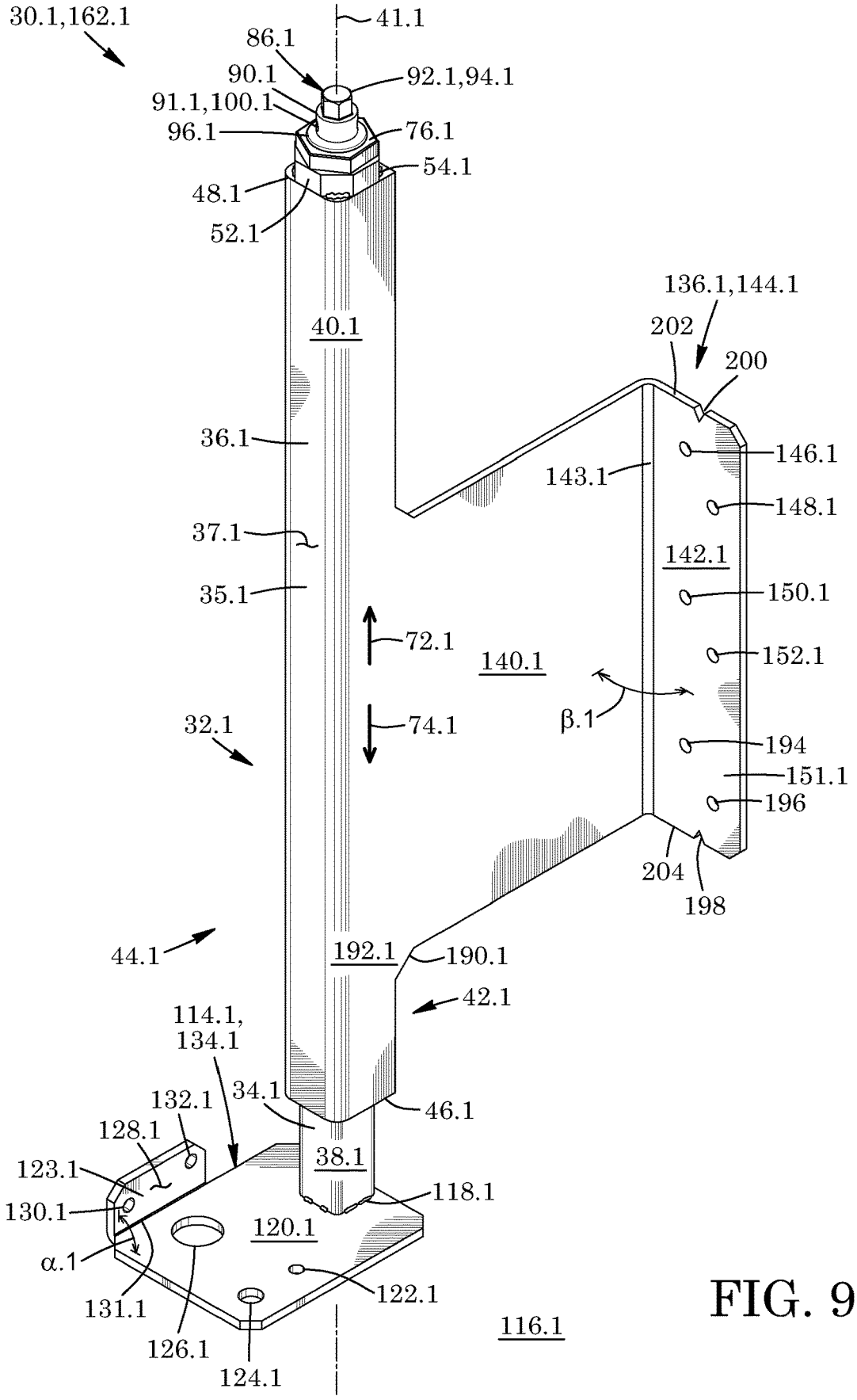
FIG. 9 is a front, top, outer side perspective view of a form support according to a second aspect.
Figure 10:
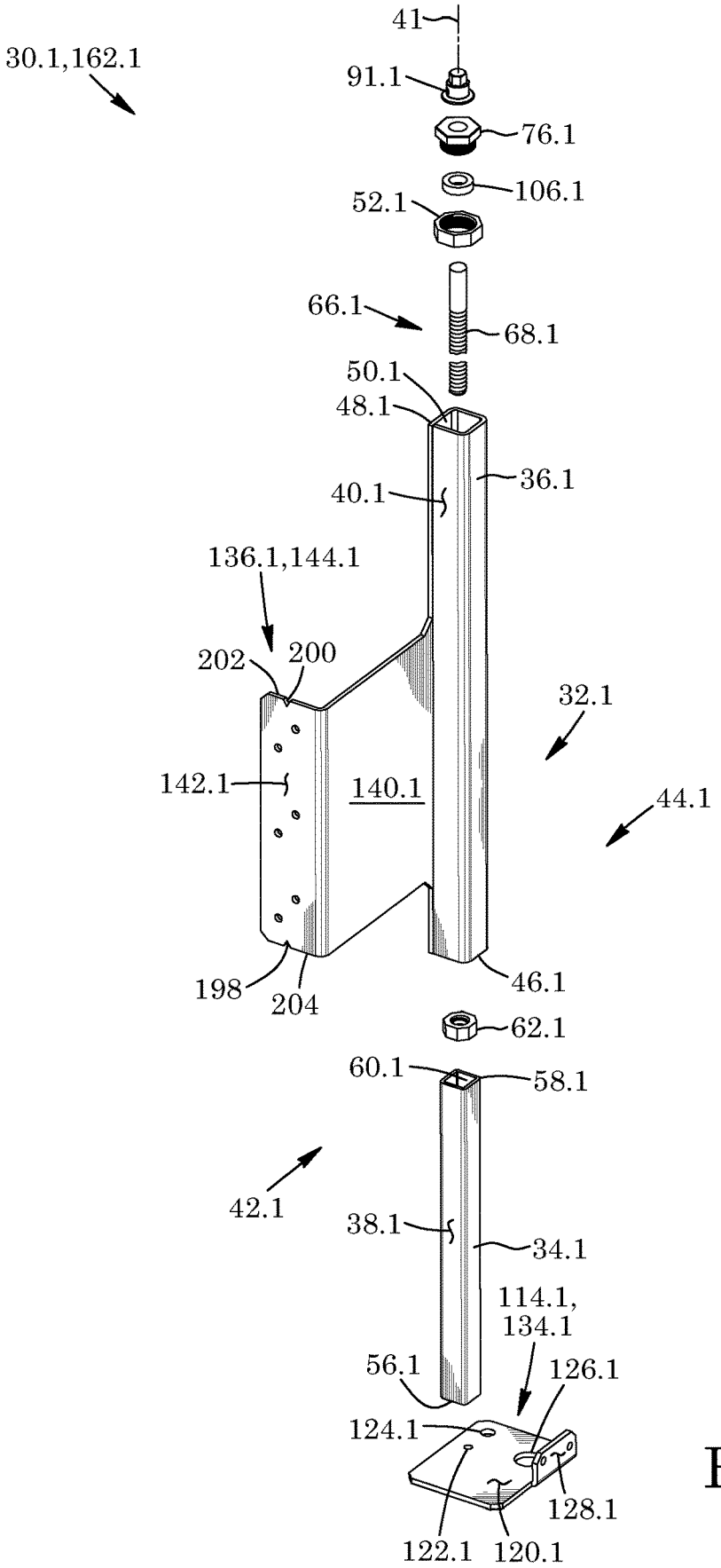
FIG. 10 is a fully exploded, rear, top, inner side perspective view thereof.
Figure 10A:
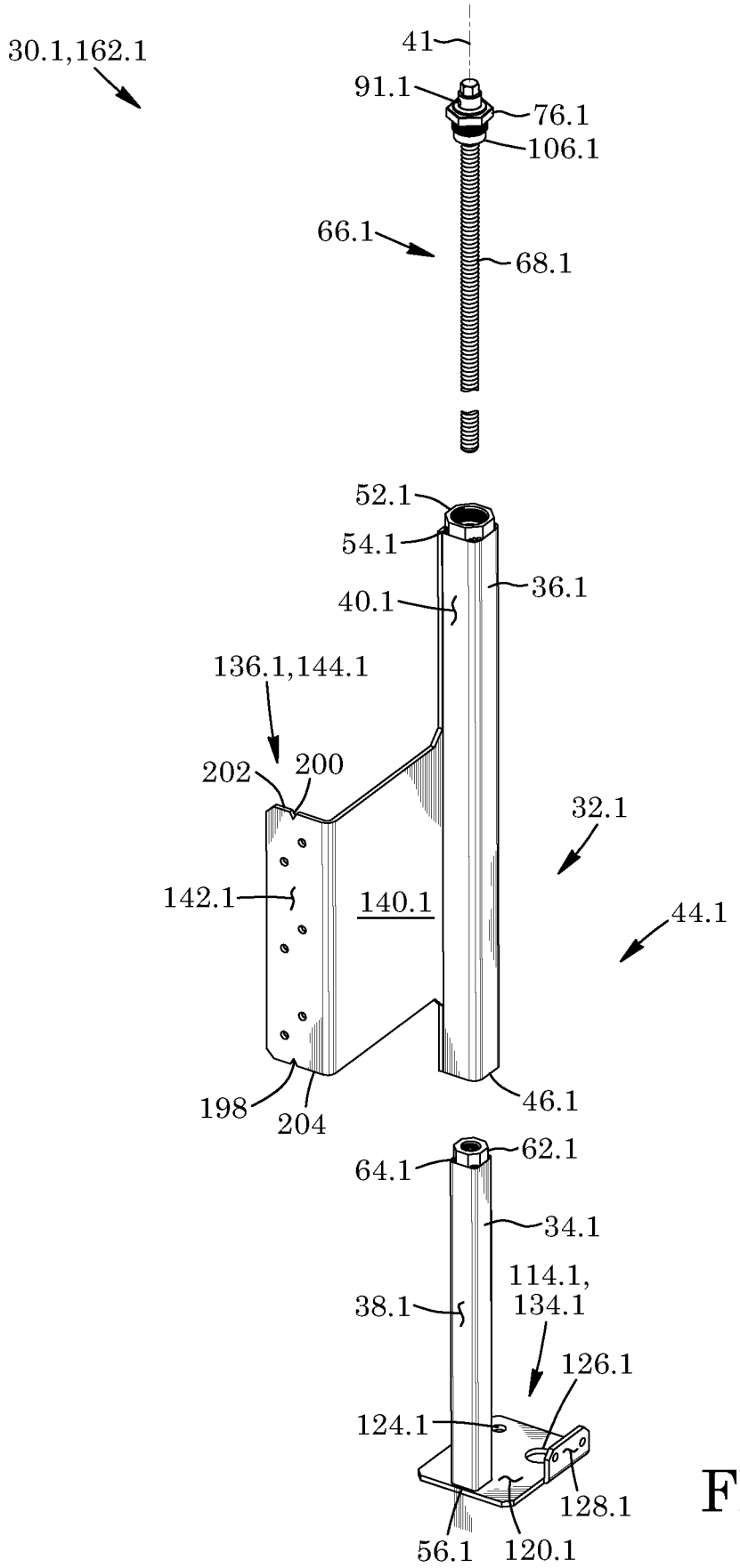
FIG. 10A is a partially exploded, rear, top, inner side perspective view thereof.
Figure 11:
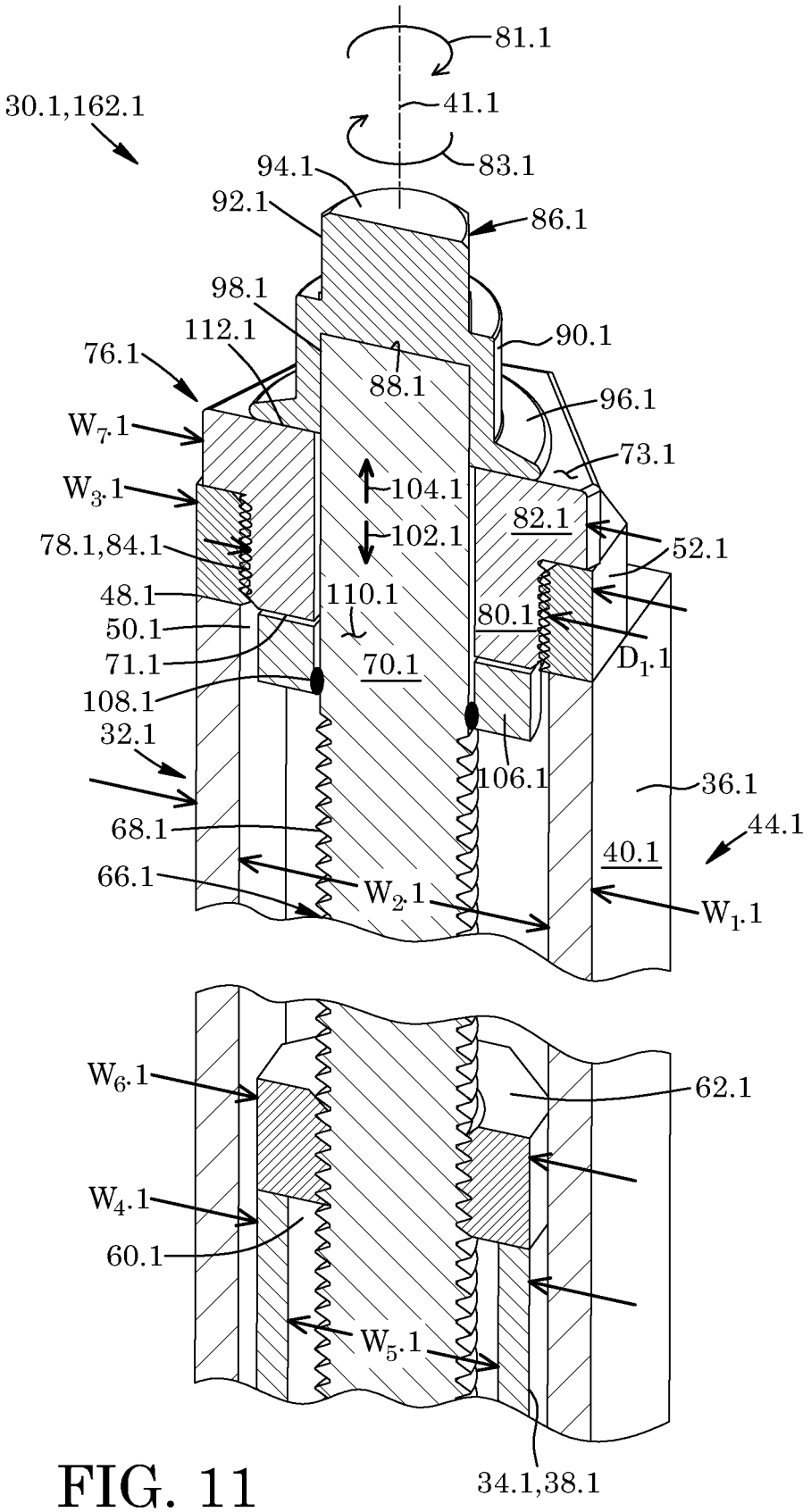
FIG. 11 is a sectional view taken along lines 9-9 of the form support of FIG. 9, the form support being shown in fragment.

Referring to FIG. 9, mount 136.1 of form support 30.1 is positioned between lower end 46.1 and upper end 48.1 of outer leg 36.1 of length-adjustable assembly 32.1 in this example. However, this is not strictly required and the mount may extend from the upper end towards lower end 46.1 of the outer leg in other embodiments for example.

First plate 140.1 of mount 136.1 spaces second plate 142.1 of the mount outwards from legs 34.1 and 36.1 to facilitate/accommodate fabric element 189 seen in FIG. 1 therebelow. The first plate of the mount is at least two to three times longer than the second plate of the mount in this embodiment. First plate 140.1 of mount 136.1 is substantially square shaped in this embodiment, though this is not strictly required. The first plate of the mount as herein described may be referred to as an extension of the mount which positions second plate 142.1 outwards from length-adjustable assembly 32.1 and base member 114.1. First plate 140.1 of mount 136.1 as herein described may be referred to as a cantilever in this embodiment, with the second plate being cantilevered to legs 34.1 and 36.1 thereby.

Brace 190.1 is shaped to support plates 140.1 and 142.1 and inhibit movement of the plates. The brace couples to and extends between first plate 140.1 and outer leg 36.1. Brace 190 is in this example in the form of a fourth or triangular plate 192. The triangular plate is integrally connected to and formed with first plate 140.1 and outer leg 36.1 so as to form a unitary whole. Brace 190.1 is downwardly facing in this non-limiting embodiment.

As seen in FIG. 9, second plate 142.1 of mount 136.1 has a third pair laterally and longitudinally spaced apart apertures 194 and 196 extending therethrough. The second plate of the mount in this non-limiting example includes at least one and in this example a pair of spaced-apart recesses or upper and lower notches 198 and 200. The upper notch is centrally positioned along an upper peripheral portion 202 of second plate 142.1 of mount 136.1 in this non-limiting embodiment. Lower notch 200 is centrally positioned along a lower peripheral portion 204 of the second plate of the mount in this example. Each notch is v-shaped in profile, though this is not strictly required.

Figure 15:
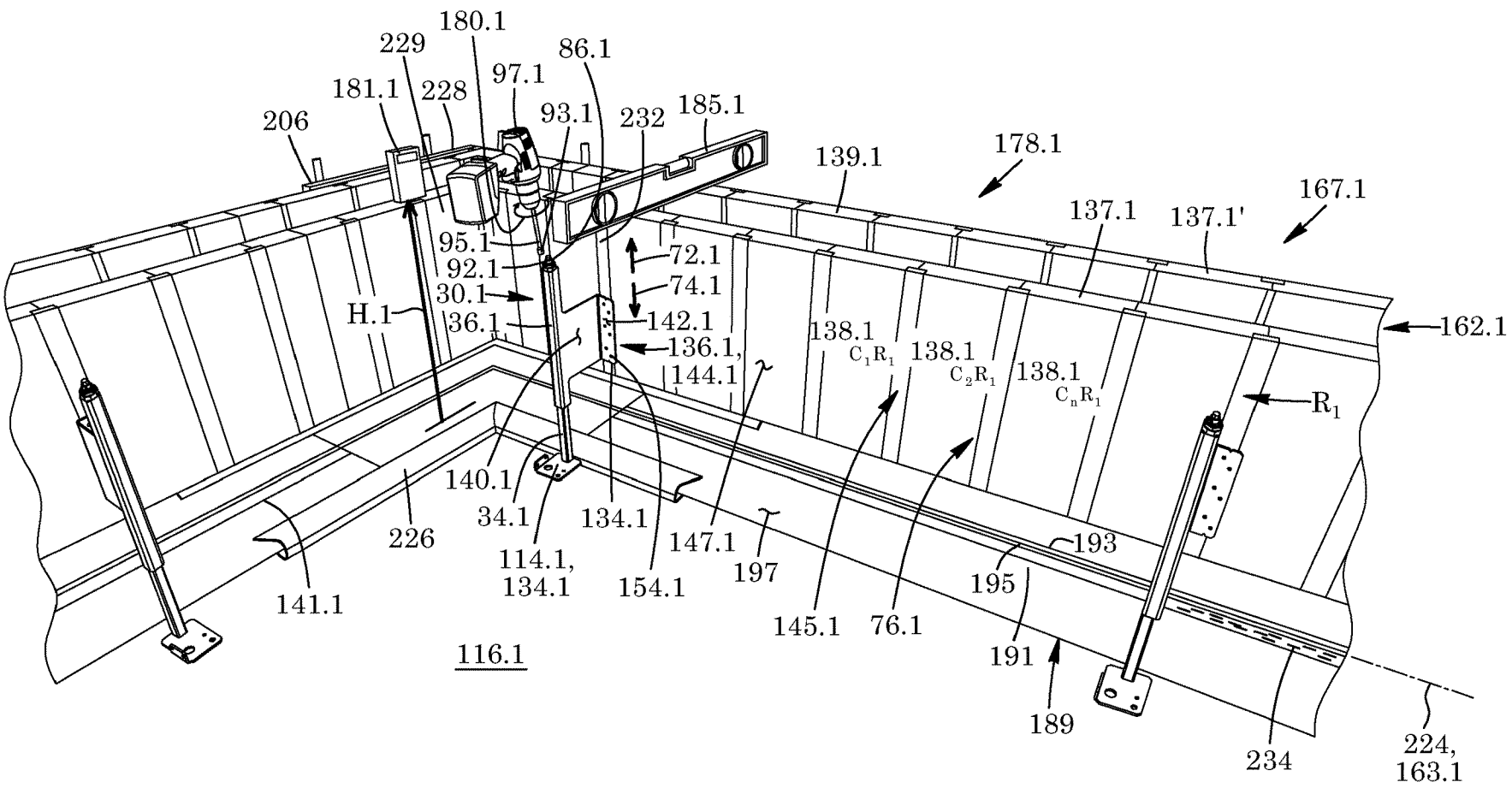
FIG. 15 is a front, top, side perspective view of the form assembly of FIG. 14 shown in fragment, with a level extending between the inner and outer insulated concrete forms, and with the inner insulated concrete form being shown in the process of being leveled relative to the outer insulated concrete form by selectively adjusting the length of one of the corresponding form supports of FIG. 9.

As seen in FIG. 15, form support 30.1 including mount 136.1 thereof are shaped to selectively couple to and support a wall form 138.1. The wall form comprises an insulated concrete form (ICF) in this non-limiting embodiment, though this is not strictly required.

A non-limiting method of using form support 30.1 and/or length-adjustable assembly 32.1 thereof, as well a non-limiting example of form assembly 136.1 that includes the same, will now be described. The method of installing the form assembly may include first levelling ground 116.1 so that the ground is substantially level or flat within a predetermined threshold.

Figure 13:
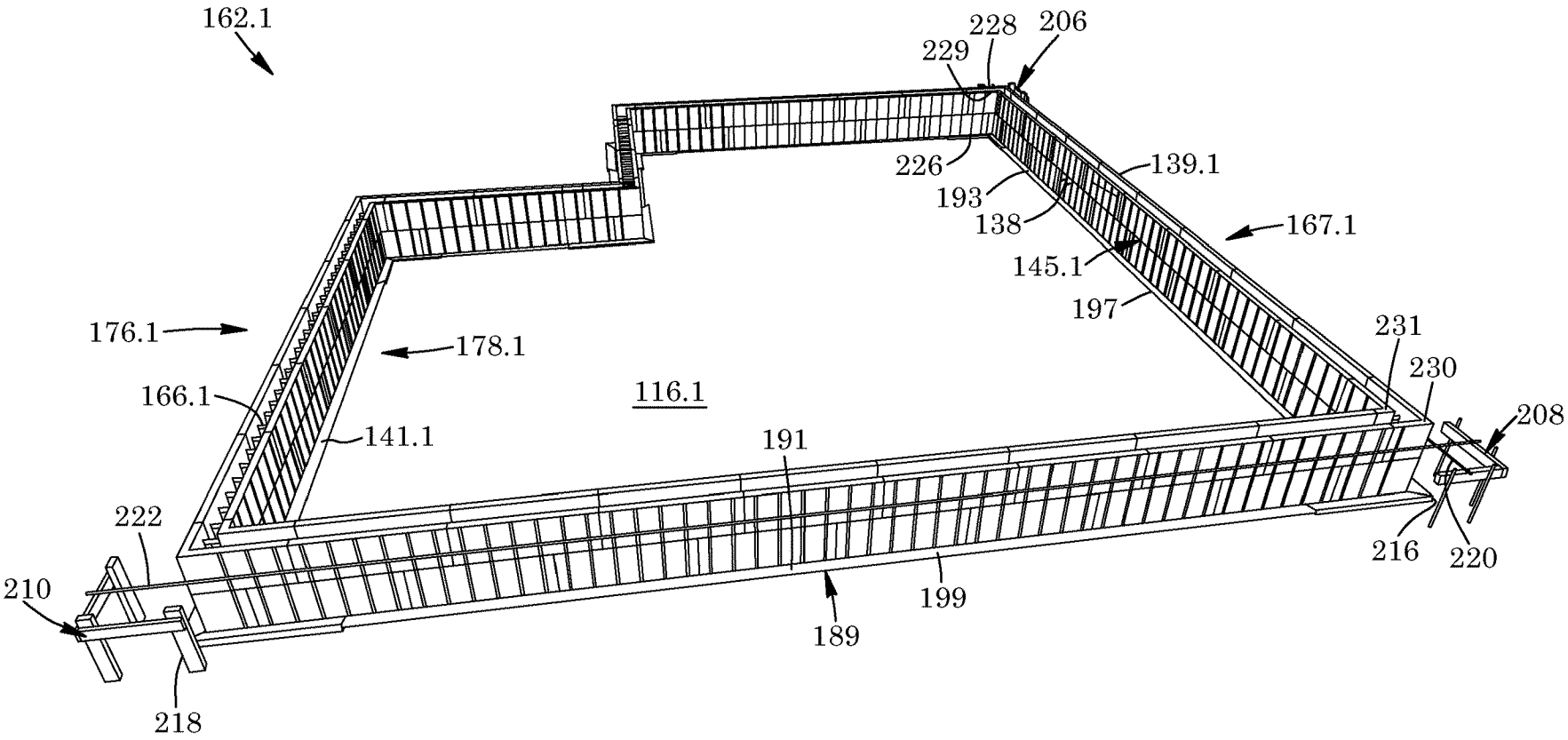
FIG. 13 is a front, top, side perspective view of the form assembly of FIG. 12, the form assembly further comprising coupled together inner and outer insulated concrete forms between which concrete is to be poured to form a wall, the insulated concrete forms aligning with and being positioned above the longitudinally-extending fabric element of FIG. 12.
Figure 14:
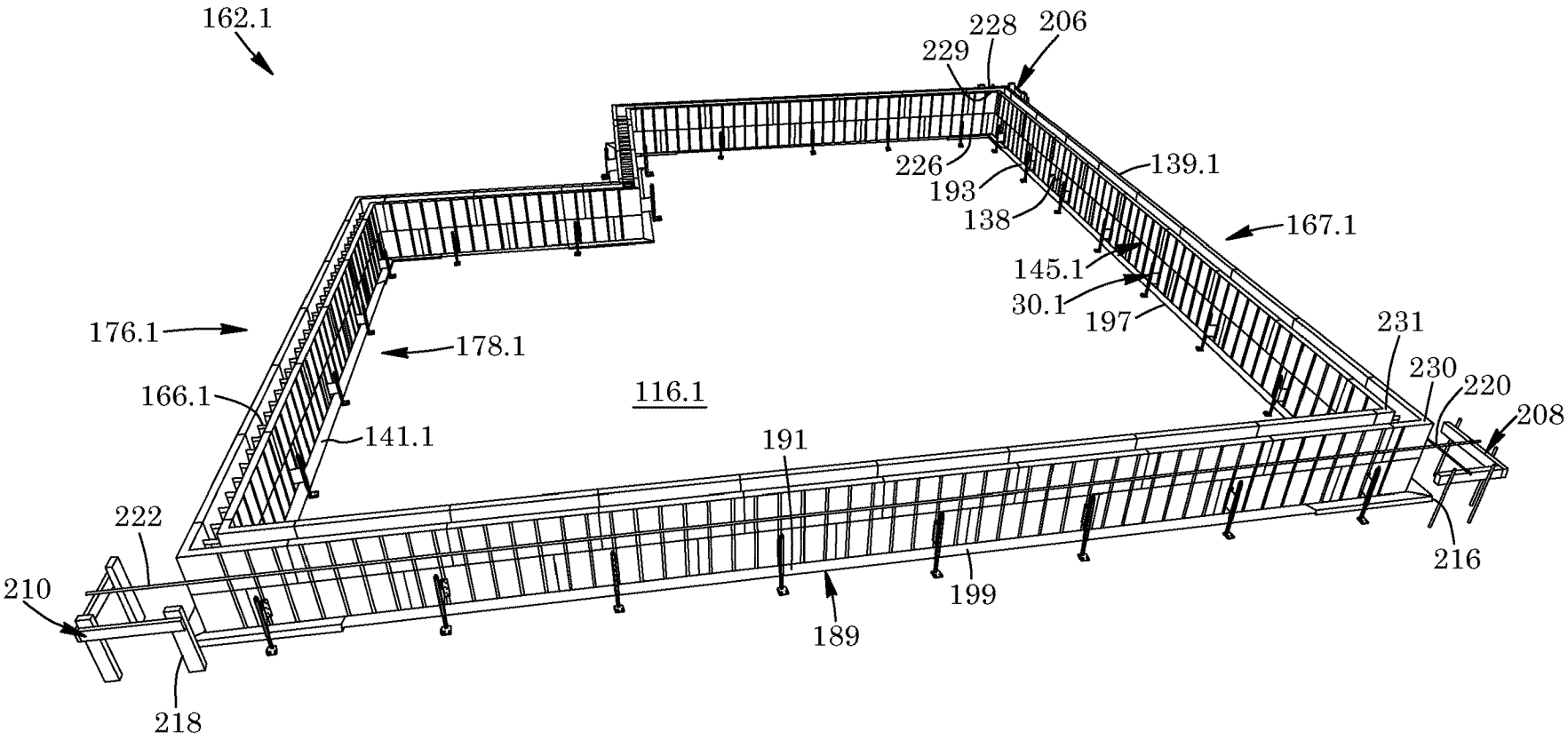
FIG. 14 is a front, top, side perspective view of the form assembly of FIG. 13, with the form assembly further comprising a plurality of pairs of form supports according to FIG. 9, the pairs of form supports being longitudinally spaced-apart and coupling to respective ones of the inner and outer insulated concrete forms.
Figure 16:
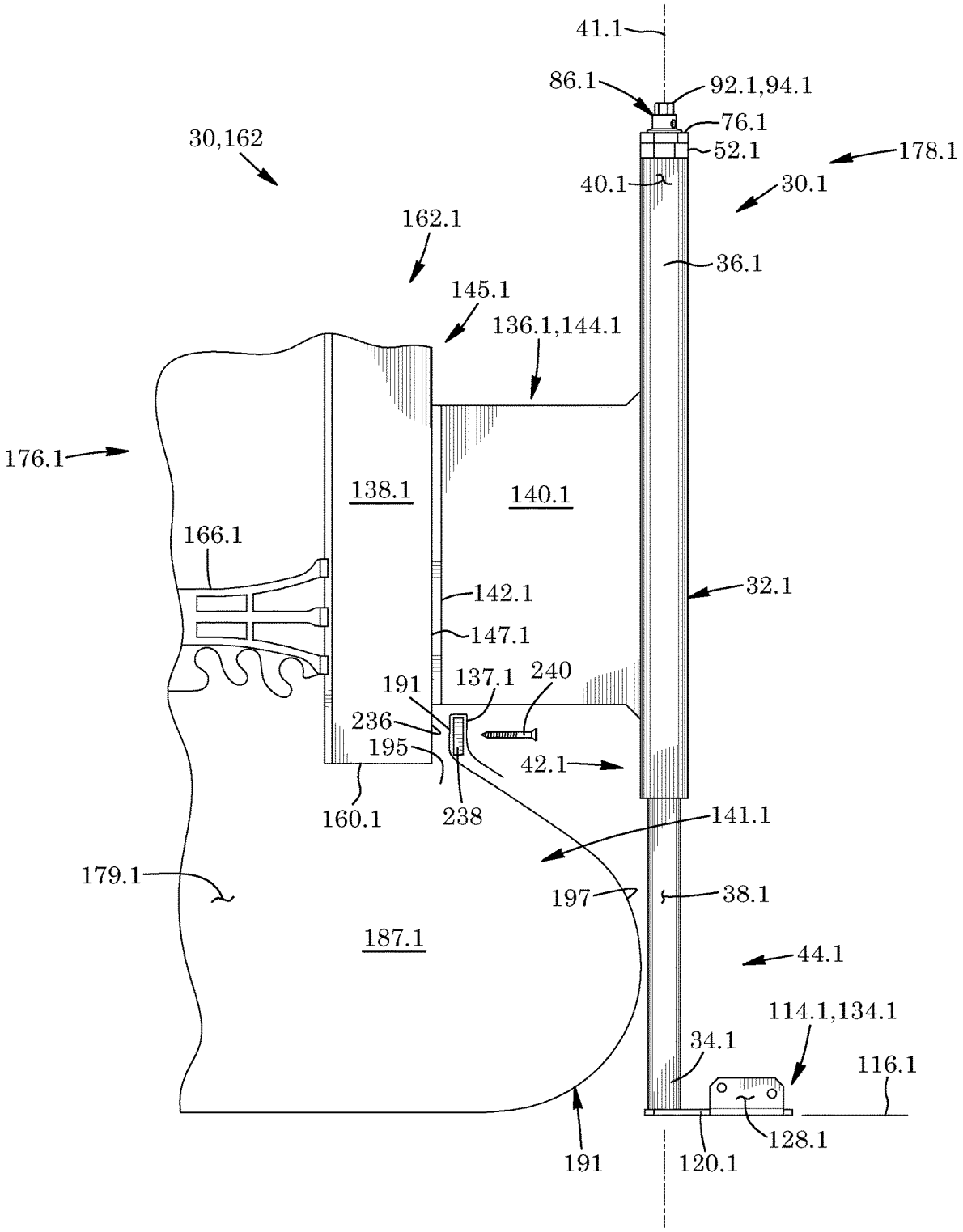
FIG. 16 is a transverse view of one of the form supports of FIG. 15, one of the insulated concrete forms of FIG. 15 shown in fragment, and the fabric element of FIG. 15 shown in fragment, with a longitudinally-extending peripheral portion of the fabric element shown in the process of coupling to a lower portion of the insulated concrete form, with the mount of the form support shown positioned above the fabric element and the lower leg of the form support being shown positioned laterally outwards of the fabric element.

Form assembly 136.1 in this example comprises corner framing or batter boards 206, 208 and 210 positioned about/around perimeter 167.1 of the foundation to be formed. The batter boards are in this example adjacent corners 214, 216 and 218 of the perimeter of the foundation. Form assembly 136.1 includes a plurality of line, in this example string line 220 and 222 coupled to and extending between adjacent pairs of batter boards 206/208 and 208/210, respectively. The string line may be may be of nylon, though this is not strictly required. String line 220 and 222 may be releasably coupled the batter boards or looped therearound so as to be readily removed when no longer needed. Referring to FIG. 13, string line 220 and 222 in one non-limiting example may be positioned so as to be located exactly two inches outside of outer wall form 139.1 and about four inches above the top of the footing 187.1 to be formed as seen in FIG. 16. However, these dimensions are by way of example only and the string line may be positioned in other manners in other embodiments.

Figure 12:
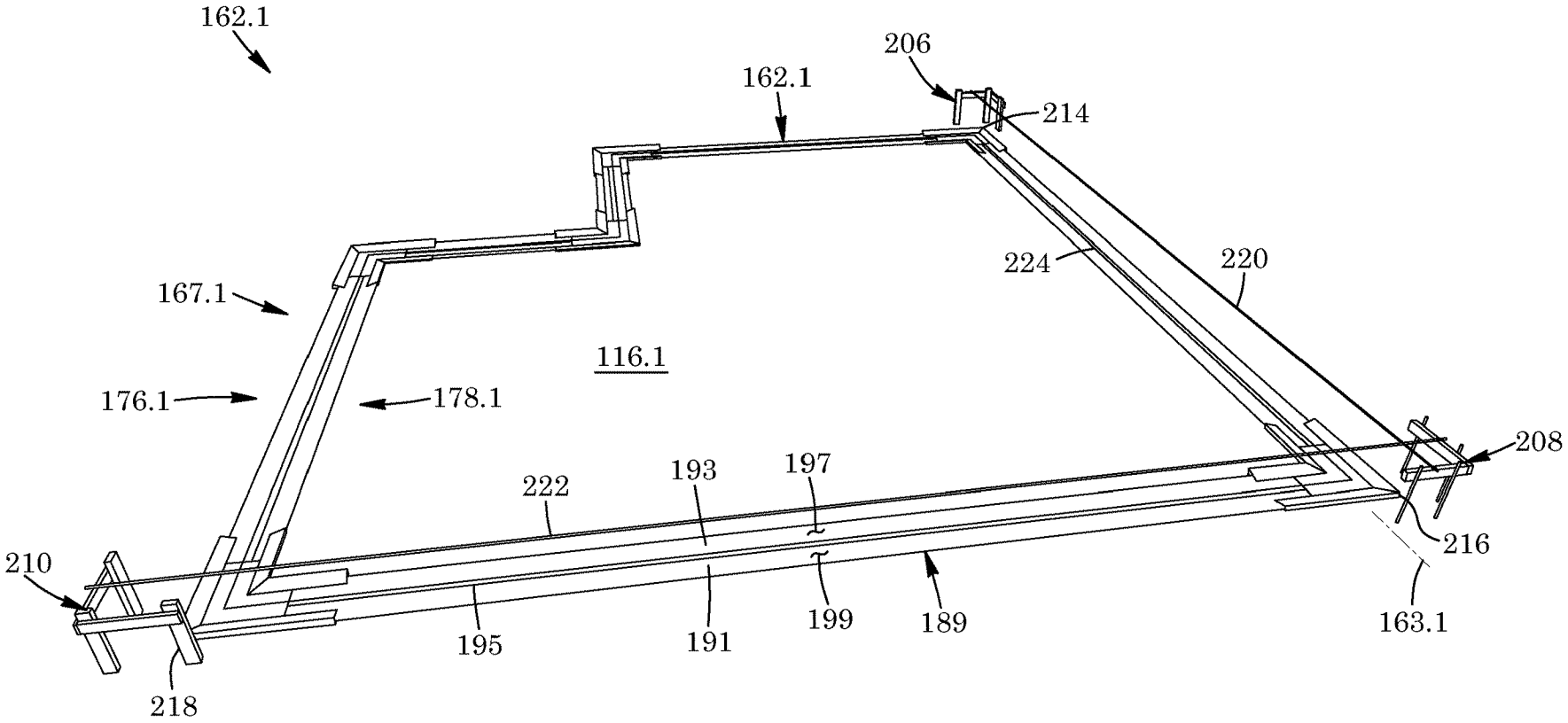
FIG. 12 is a front, top, side perspective view of a form assembly according to another aspect, the form assembly comprising a longitudinally-extending fabric element shaped to form a channel within which concrete is poured to form a footing of a foundation, the form assembly also including batter boards to which layout lines couple.

Referring to FIG. 12, using string line 220 and 222 as guide, the method of installing form assembly 136.1 may next include placing indicia, in this example in the form of spray paint, on ground 116.1 along a centerline 224 around perimeter 176.1. The centerline extends along and parallel to longitudinal axis 163.1 in this example. Centerline 224 may function to guide the eventual location of wall forms 138.1 and 139.1 seen in FIG. 13.

Referring back to FIG. 12, form assembly 162.1 includes longitudinally-extending fabric element 189. The fabric element is unrolled and positioned on ground 116.1 so as to centrally overlay centerline 224. Reinforcement materials or fabric element corner assemblies 226 are positioned along corners 214 of foundation 167.1, which may be referred to as Fastfoot Monopour® corners and Ts. Fabric element 189 may be arranged with an overlap between adjacent longitudinally-extending portions thereof and which is equal to twice the web spacing, though this is not strictly required. Sheathing tape (not shown) may next be applied onto each overlapped portion to hold adjacent fabric elements so coupled together in position, thereby inhibiting concrete leakage therebetween and therethrough.

Referring to FIG. 13, form assembly 162.1 in this example includes a plurality of adjacent pairs of inner and outer wall corner forms 228/229 and 230/231. The method of installing the form assembly may include placing the adjacent pairs of wall corner forms over each fabric element corner assembly 226 around perimeter 176.1 of the foundation, in this non-limiting example approximately two inches away from each string line 220.

As seen in FIG. 16, form assembly 162.1 includes as plurality of wall forms 138.1 and 139.1. The wall forms are planar. Each wall form 138.1 may comprise a plurality of wall form portions $\mathbf{138.1}_{C1R1}$, $\mathbf{138.1}_{C2R1}$, . . . $\mathbf{138.1}_{CnRm}$ arranged in overlapping columns $C_1$, $C_2$, . . . $C_n$ and rows $R_1$, $R_2$, . . . $R_m$, to form a wall of dimensions as desired. The method of installing form assembly 162.1 may next include infilling between wall corner forms 228/229 and 230/231 using the planar or rectangular wall forms or portions thereof. The method of installing the form assembly may next include coupling together adjacent wall form portions $\mathbf{138.1}_{C1R1}$ and $\mathbf{138.1}_{C2R1}$ within a first or lower row $R_1$ thereof. The wall forms in one non-limiting embodiment may be coupled together via adhesive or spray foam along each vertical joint, with zip ties or proprietary clips holding the glued joints together thereafter.

Referring to FIG. 13, the method may next include placing a second layer or row $R_2$ of wall form portions $\mathbf{138.1}_{C1R2}$ and $\mathbf{138.1}_{C2R2}$ over lower row $R_1$ of wall form portions $\mathbf{138.1}_{C1R1}$ and $\mathbf{138.1}_{C2R1}$, and coupling the rows together via adhesive or spray foam along horizontal and vertical joints for extra stability. This may be repeated until wall forms 138.1 and 139.1 of the desired dimensions are built. The wall forms so formed are coupled together via a plurality of crosspieces 166.1.

As seen in FIG. 15, form assembly 162.1 for each pair of corresponding and parallel wall forms 138.1 and 139.1, includes one or more pairs of form supports 30.1 extending the outer and inner sides 176.1 and 178.1 of the pairs of wall forms. In this example the pairs of form supports are longitudinally spaced-apart along the respective ones of the wall forms. However, this is not strictly required and pairs of aligned form supports on the outer and inner sides of the pairs of wall forms are not strictly required and may be staggered with respect to each other in other embodiments. The method of installing form assembly 162.1 may thus comprise aligning one or more form supports on opposite sides of the wall forms. Form supports 30.1 may be arranged around perimeter 167.1 and the wall forms with a spacing of four to six feet on center in one non-limiting embodiment, though this is not strictly required. The form supports may be positioned closer together longitudinally where wall forms 138.1 and 139.1 are arranged for higher walls to be formed, for example.

The method of installing form assembly 162.1 may include aligning one or more form supports 30.1 on opposite sides of wall forms 138.1 and 139.1 such that second plate 142.1 of mount 136.1 of the form support extends along and abuts a side portion 147.1 of one of the wall forms 138.1. In this non-limiting example, the second plate of the mount of the side support abuts and extends along a web 232 between adjacent wall form portions, though this is not strictly required. Notches 198 and 200 of second plate 142.1 of mount 136.1 of form support 30.1 seen in FIG. 9 are used in this non-limiting example to facilitate centering the second plate over and relative to the web seen in FIG. 15. The method of installing form assembly 162.1 may include centering one or more of the notches directly over web 232 seen in FIG. 15.

Still referring to FIG. 15, second plate 142.1 of mount 136.1 of form support 30.1 is shaped to selectively couple to side portion 147.1 of wall form 138.1 via fasteners, in this example non-limiting example 1½" deck screws 154.1. Up to four or more screws may be used for coupling each form support to its respective wall form 138.1, though here too this is not strictly required. Form supports 30.1 may be installed in their extended or at least partially extended positions in this example to accommodate positioning of fabric element 189 at least partially therebelow, though this is not strictly required. As seen in FIG. 17, mounts 136.1 of the form supports so shaped, with first plates 140.1 thereof, thus accommodate and/or are spaced outwards from side portions 197 and 199 of the fabric element positioned therebelow.

Figure 17:
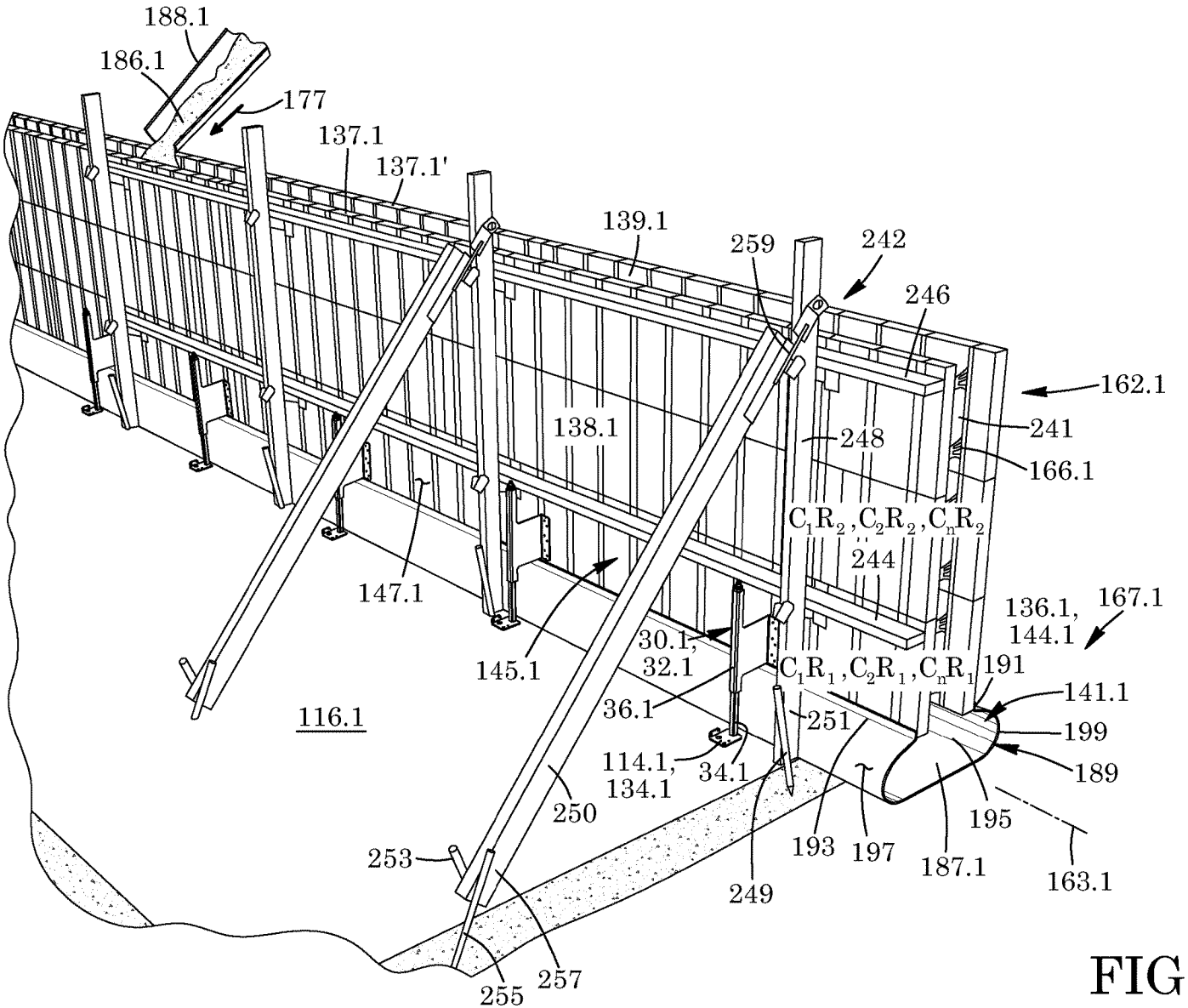
FIG. 17 is a front, top, side perspective view of the form assembly of FIG. 16 shown in fragment, with the longitudinally-extending peripheral portions of the fabric element shown coupling to respective inner and outer insulated concrete forms so as to form a unitary form, with the insulated concrete forms being arranged in multiple rows/columns and being supported and leveled positions via the form supports, and with the form assembly including bracing which functions to further support the insulated concrete forms.

As seen in FIG. 17, form support 30.1 may next be length or height adjusted to the correct or desired elevation. This adjustment may be enabled by coupling drill bit 93.1 of driver 95.1 to drill-bit engageable end 92.1 and selectively actuating electric drill 97.1 thereafter as shown by direction of rotation 180.1. A first height alignment device, in this example laser 181.1 is used to get the exact desired height H.1 or level line, though this is not strictly required. The method of installing form assembly 162.1 may thus comprise selectively adjusting the length or height of wall forms 138.1 and 139.1 by selectively rotating threaded shaft 66.1 seen in FIG. 11 via a power tool or electric drill 97.1 seen in FIG. 15 for one or more form supports 30.1 until the wall forms are at a substantially correct or desired elevation. The method of installing the form assembly may include using laser 181.1 to delineate the correct or desired elevation and adjusting the wall forms to substantially align with a beam of light emitted by the laser.

A second height alignment device, in this example level 185.1 may extend along tops 137.1 and 137.1' of wall forms 138.1 and 139.1, or portions of a row thereof, to ensure that wall form 138.1 is substantially level with wall form 139.1. The level may thus be used to simultaneously adjust or selectively adjust thereafter opposite wall form 139.1.

Form assembly 162.1 may include one or more strengthening members, in this example in the form of a plurality of twisted metal or steel rods 234. The steel rods may comprise Micro Rebar®, which is owned and may be purchased at Pensmore Reinforcement Technologies, LLC DBA Helixsteel™, having a location at 2300 Washtenaw Ave #201, Ann Arbor, MI 48104, United States. However, this is not strictly required and other types of metal or steel rods or other strengthening members may be used in other embodiments. The method of installing form assembly 162.1 may include opening up fabric element 189 so as to position and disperse steel rods 234 within channel 195 of the fabric element and longitudinally therealong and on footing chairs thereof, for example. Centerline 224 of fabric element 189 may be used to optimize positioning and dispersal of the steel rods so inserted within the fabric element. Using Micro Rebar® or like products may provide the advantage of avoiding the need to install steel reinforcing rods or rebar. However, this is not strictly required and the strengthening member may comprise steel reinforcing rods or rebar in other embodiments.

Referring to FIG. 17, the method of installing form assembly 162.1 may next include coupling peripheral portions 191 and 193 of fabric element 189 to couple wall forms 138.1 and 139.1 (either on the inside or outside thereof) so as to form upwardly-facing channel 195.1 below wall forms 138.1 and 139.1 and within which concrete may be also poured to form the footing of the foundation. As seen in FIG. 16, the peripheral portions of the fabric element couple to bottom 160.1 and in this example a lower outer side peripheral portion 236 of the wall form. In this non-limiting example, peripheral portions 191 extend about an elongate member or batten 238, with the batten and peripheral portion of the fabric element 189 so wrapped therearound, coupling to the lower outer side peripheral portion of wall form 138.1 via with a plurality of longitudinally spaced-apart fasteners, in this example deck screws 240. The distance from the centerline may be measured, with the fabric element then folded over the batten, which in one non-limiting example comprises plywood sized ¾ "×1½". Batten 238 and fabric element 189 may be screwed to each web or wall form portion using 1½" deck screw 240 in one non-limiting embodiment.

As seen in FIG. 17, the fabric element so coupled to wall forms 138.1 and 139.1 is longitudinally-extending and in fluid communication with the wall forms. Fabric element 189 so coupled to the wall forms includes side portions 197 and 199 which are outwardly convex in this example. The side portions of the fabric element protrude laterally outwards relative to wall forms 138.1 and 139.1 in this example. A combined form is thus effectively constructed for the footing and walls to be formed by concrete to create footing 187.1 built by fabric element 189 and a wall, in this example an ICF wall 241 built by wall forms 138.1 and 139.1. Form supports 30.1 so coupled to the wall forms, is thus selectively length/height adjusted so as to lift up the ICF wall or wall forms for levelling and height correction and so as to create a sufficient space to form a footing underneath using fabric element 189, which may comprise Fastfoot® footing forms.

As seen in FIG. 17, form assembly 162.1 may include a brace assembly 242 configured to brace wall forms 138.1 and 139.1. The following is a non-limiting embodiment of a brace assembly which achieves the above functionality.

Brace assembly 242 in this example comprises one or more longitudinally-extending horizontal members: in this example two longitudinally-extending and laterally-spaced apart rows of lumber 244 and 246. The horizontally-extending lumber is configured to extend along and abut adjacent wall form 138.1 thereof in this example. Brace assembly 242 in this non-limiting example comprises in this example a plurality of longitudinally spaced-apart and upright or vertically-extending members, in this example lumber 248. The vertically-extending lumber may be held in place with stakes 249 extending into ground 116.1 and holding lower portions 251 thereof in place. Lumber 248 is configured to extend along and abut adjacent wall form 138.1 thereof in this example. Alternatively, instead of longitudinally-extending lumber 244 and 245 and vertically-extending lumber 248, there may be provided a plurality of lumber which extends along and abuts wall form 138.1 but which is angled relative to the horizontal and vertical for example.

Brace assembly 242 in this non-limiting embodiment comprises a plurality of longitudinally spaced-apart and inclined or angled members, in this example lumber 250. The angled lumber couples to wall form 138.1 and extends outwards and downwards therefrom towards ground 116.1. Angled lumber 250 may be held in place via one or more stakes 253 and 255 extending into the ground and holding lower portions 257 thereof in place. Brace assembly 242 in this non-limiting example comprises a plurality of longitudinally spaced-apart connectors, in this example turnbuckles 259. Respective vertically-extending lumber 248 couples to respective angled lumber 250 via the connector or turnbuckles 259 which may be selectively adjustable.

Brace assembly 242 so coupled together abuts horizontally-extending lumber 244 and 246. The brace assembly is truss shaped in lateral profile in this example. Brace assembly 242 is arranged so as to support wall forms 138.1 and 139.1 while not interfering with fabric element 189. The brace assembly may comprise Zont™ bracing in one non-limiting example. The base of wall form 138.1 may be aligned to be exactly two inches from string lines 220 seen in FIG. 14 in one non-limiting example. Referring back to FIG. 17, the method of installing form assembly 162.1 may thus include next plumbing top 137.1 of wall forms 138.1 and 139.1 with turnbuckles 259 and kickers. Mount 136.1 seen in FIG. 9 is spaced below upper end 48.1 of outer leg 36.2 and this may function to facilitate brace assembly 242 seen in FIG. 17 or components thereof.

Still referring to FIG. 17, concrete 186.1 is next poured via in this example concrete chute 188.1 into form 141.1 made of coupled together wall forms 138.1 and 139.1 and fabric element 189 so coupled to the wall forms therebelow. The concrete may be screeded to tops 137.1 of the wall forms. Form supports 30.1, wall forms 138.1 and 139.1, crosspieces 166.1 and brace assembly 242 may thereafter be removed once the concrete has set and after a threshold period of time, such as the next day in one non-limiting example. The method of installing form assembly 162.1 may be part of a method of forming a foundation, with the method including pouring concrete into the enclosure or wall and footing forms so built by the wall forms so height-adjusted and fabric element 189 coupled thereto therebelow.

Form support 30.1 as herein described may be referred to as an adjustable monopour side support in this example. The term monopour refers to the foundation wall and footing being poured using wet concrete at the same time. Form assembly 162.1, including form support 30.1, wall forms 138.1 and 139.1 and fabric element 189 thereof, may thus comprise an alternative apparatus and method for forming and pouring an insulated concrete form (ICF) wall and footing at the same time.

Many advantages may result from form assembly 162.1, form support 30.1 thereof and length-adjustable assembly 32.1 thereof. For example and referring to FIG. 17, the form assembly so configured may enable the contractor to form and pour footing 187.1 formed by fabric element 189 and ICF wall 241 built by wall forms 138.1 and 139.1 at the same time, with the fabric element being formed automatically under the ICF wall with no need for separate lumber footing forms. Form assembly 162.1, including form supports 30.1 thereof, may enable the contractor to readily and quickly adjust the ICF wall to the precise height using electric drill 97.1 actuating drill-bit engageable end 92.1 seen in FIG. 15 in a manner that protects length-adjustable assembly 32.1 on the one hand (threading 68.1 of threaded shaft 66.1 seen in FIG. 11 for height-adjustment is located inside legs 34.1 and 36.1 so that concrete cannot damage them), while enabling the length-adjustable assembly to be selectively disassembled, inspected, maintained and the like on the other hand. Form supports 30.1 as herein described are thus reusable and repairable. Referring back to FIG. 17, the form supports are easily stripped by unscrewing second plate 154.1 of mount 136.1 from the poured ICF wall 241 thereafter. Form supports 30.1 and length-adjustable assembly 32.1 as herein described may also enable the ICF wall to be height adjusted at any point in the building process for example.

FIGS. 18 to 21 show a form assembly 162.2 and form support 30.2 thereof according to an additional aspect. Like parts have like numbers and functions as form assembly 162.1 and form support 30.1 thereof shown in FIGS. 9 to 17 with decimal extension "0.2" replacing decimal extension "0.1" and being added for part numbers not previously having decimal extensions. Form assembly 162.2 and form support 30.2 are substantially the same as form assembly 162.1 and form support 30.1 shown in FIGS. 9 to 17 with at least the following exceptions.

Figure 18:
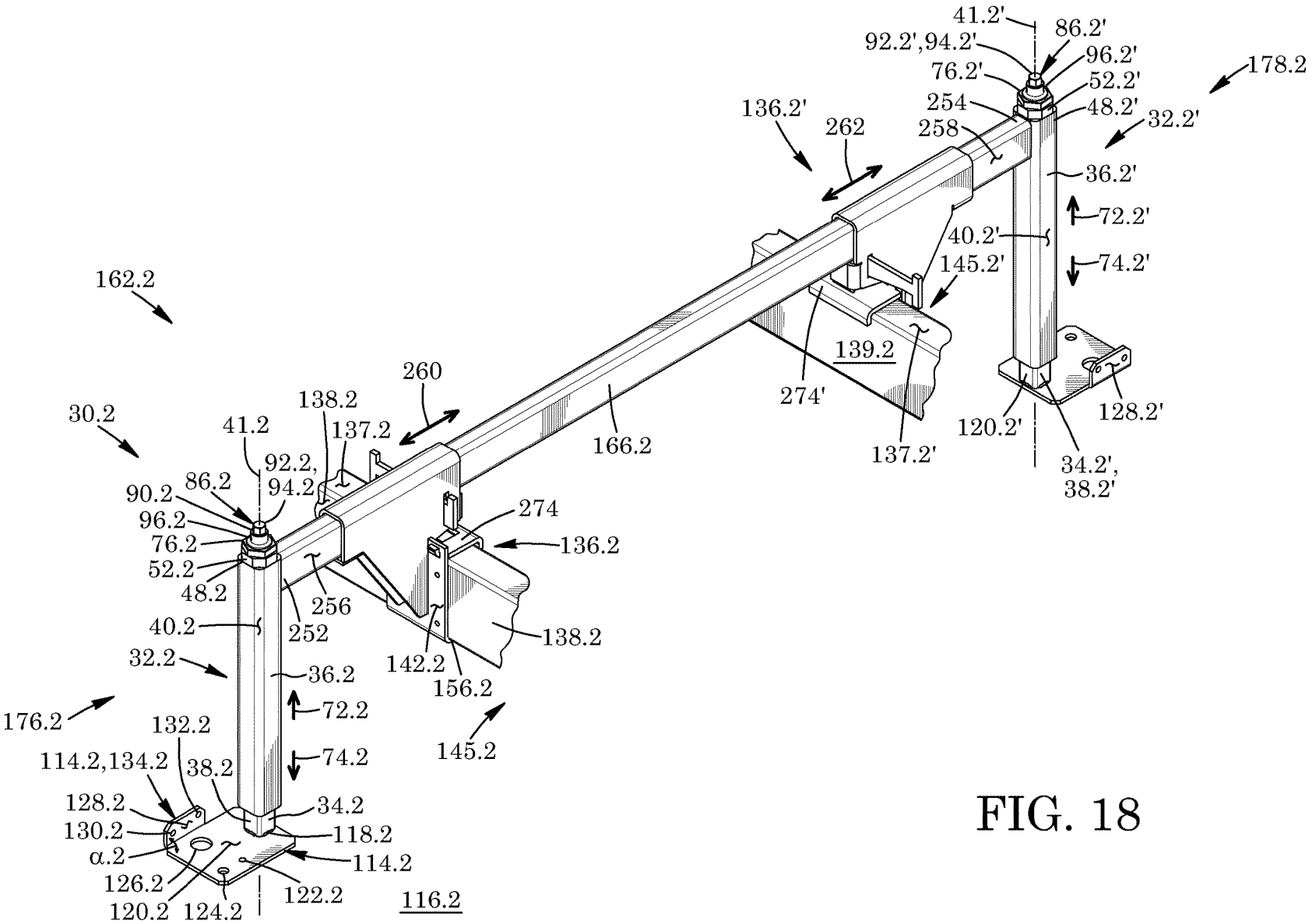
FIG. 18 is a front, top, side perspective view of a form assembly and form support according to an additional aspect, the form assembly including a pair of inner and outer footing boards coupled to the form support and between which concrete is to be poured to form a footing of a foundation, the inner and outer footing boards being shown in fragment.
Figure 19:
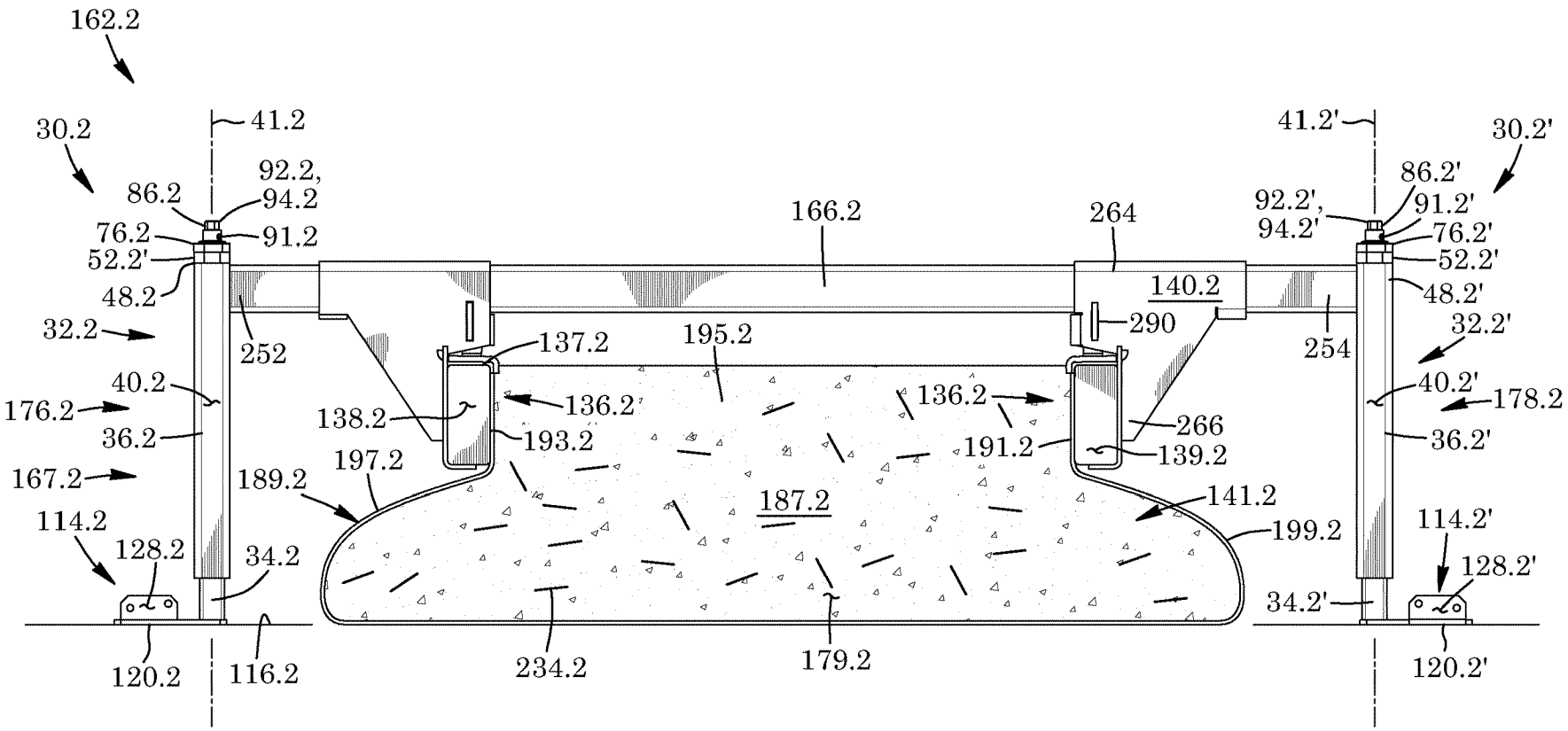
FIG. 19 is a front elevation view of the form assembly, form support and footing boards of FIG. 18, with the form assembly further comprising a longitudinally-extending fabric element coupled to the footing boards and shaped to form a channel within which concrete is to poured to further form the footing of the foundation.

As seen in FIG. 18, form assembly 162.2 in this non-limiting embodiment comprises a pair of form supports 30.2 and 30.2' which are substantially identical, with like parts having like numbers with the addition '. The form supports face each other and are coupled together via an elongate member, in this example crosspiece 166.2. Form supports 30.2 and 30.2' may thus be referred to as a single form support comprising two parts or portions thereof. Crosspiece 166.2 comprises an elongate tube that is square shaped in lateral cross-section; however, this is not strictly required and the crosspiece may be solid and/or have other shapes in lateral cross-section in other embodiments. The crosspiece has a pair of spaced-apart end portions 252 and 254 which couple to upper ends 48.2 and 48.2' of form supports 30.2 and 30.2'

Still referring to FIG. 18, the form supports include mounts 136.2 and 136.2' coupled to and extending outwards from respective outer legs 36.2 and 36.2.' of length-adjustable assemblies 32.2 and 32.2'. The mounts couple to the outer legs via end portions 256 and 258 of crosspiece 166.2 in this example. Mounts 136.2 and 136.2' are slidably coupled to the crosspiece and longitudinally-adjustable relative to their corresponding outer legs 36.2 and 36.2' of form supports 30.2 and 30.2' as shown by arrows 260 and 262.

Each mount is substantially the same in parts and function and only mount 136.2' therefore will be described in detail. The mount includes a base 264 which extends about crosspiece 166.2 with at least one and in this example a pair of first planar members or braces, in this example brace plates 140.2 and 140.2A coupled thereto and extending downwardly therefrom. The brace plates are integrally connected to the base so as to form a unitary whole in this example, though this is not strictly required. Each brace plate 140.2 is triangular in side profile in this non-limiting embodiment.

Figure 21:
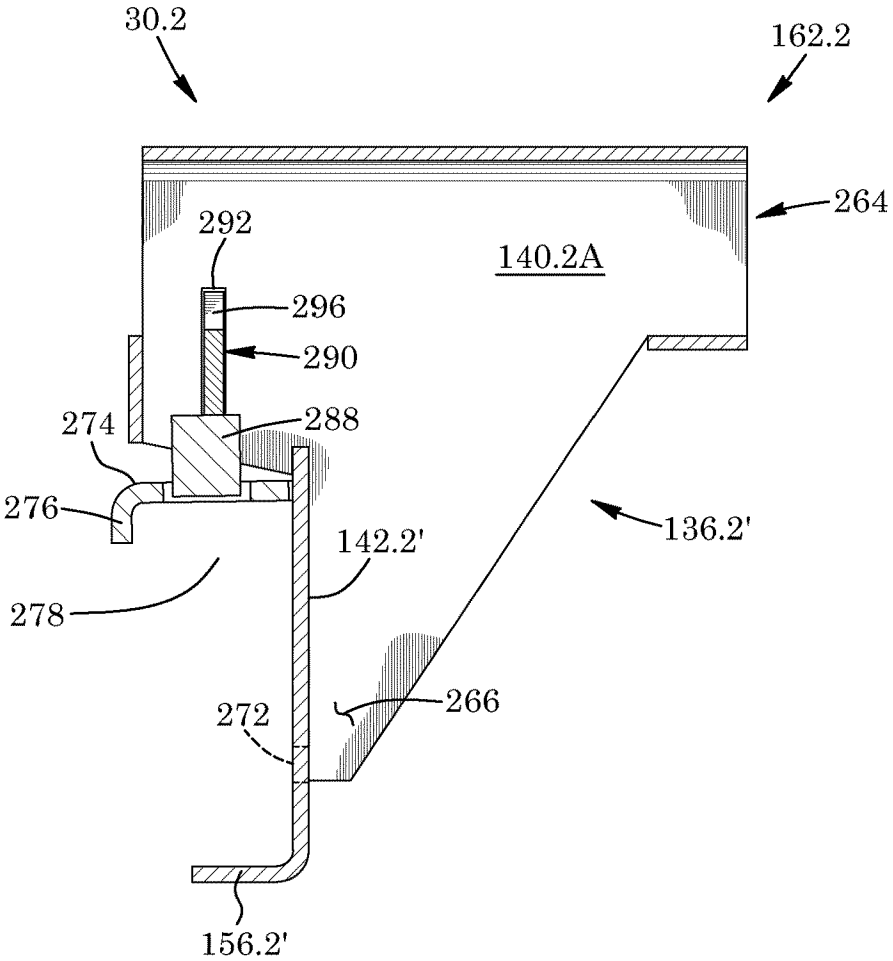
FIG. 21 is a sectional view taken along lines 21-21 of the mount of FIG. 20.
Figure 20:
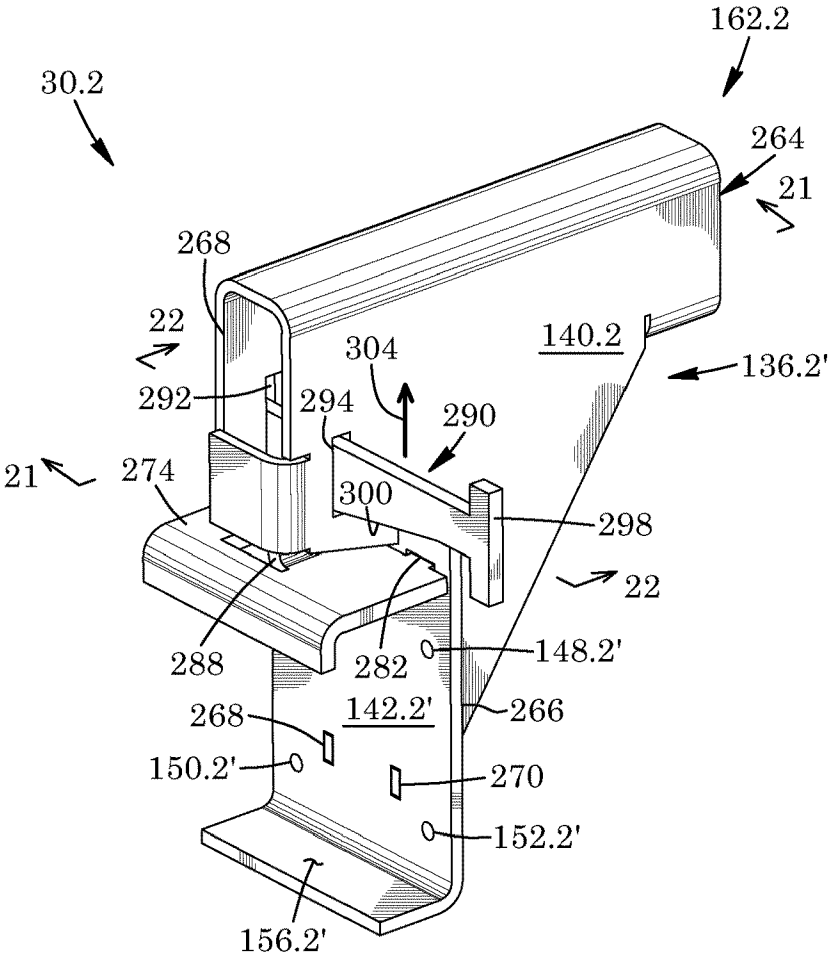
FIG. 20 is a top, side perspective view of one of the mounts of the form support of FIG. 18, with the outer footing board of the form assembly not being shown coupled thereto.

Mount 136.2' includes a form-engaging member comprising in this example second and third planar members, in this example second plate 142.2' and third plate 156.2' coupled to and angled relative to the second plate thereof. Base 264 of the mount couples to the plates. In this example and as seen in FIG. 21, tapered portions 266 of brace plates 140.2A' extend along, couple to and support second plate 142.2'. As seen in FIG. 20, in this non-limiting embodiment second plate 142.2' has a pair of engagement elements, in this example female engagement elements, in this case inner apertures 268 and 270. As seen in FIG. 21, each brace plate 140.2A in this non-limiting example includes a tab 272 adjacent tapered portion 266 thereof and which is shaped to selectively fit within a respective aperture 268 of the second plate. Second and third plates 142.2' and 156.2' selectively couple to base 264 of mount 136.2' thereby, though this is not strictly required.

Figure 22:
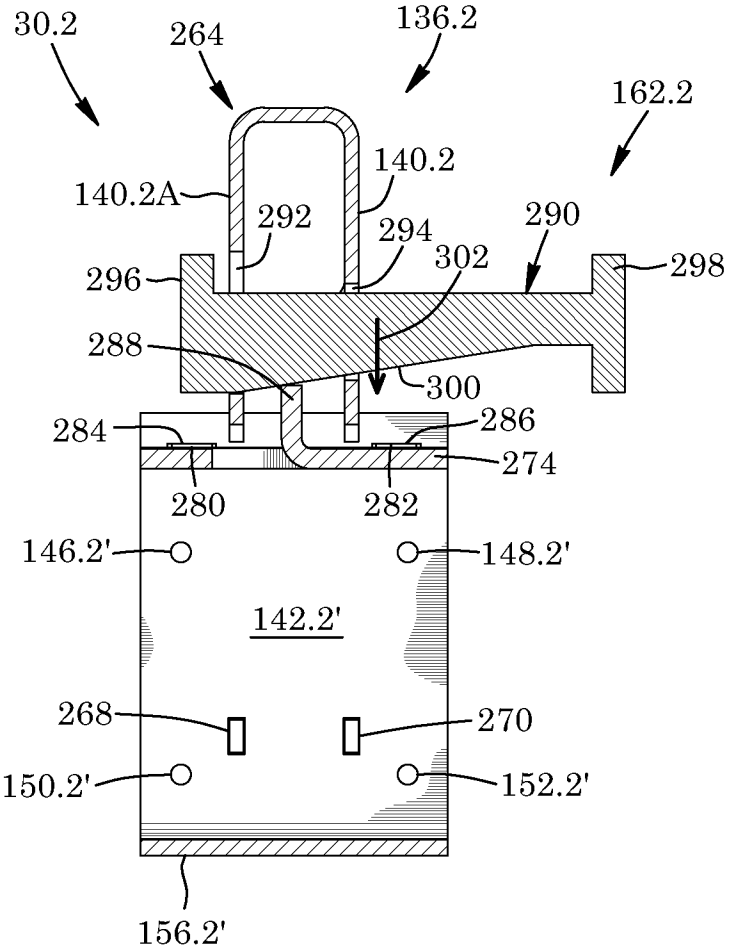
FIG. 22 is a sectional view taken along lines 22-22 of the mount of FIG. 20.

As seen in FIG. 20, in this non-limiting embodiment each mount includes a fourth planar member, in this example a fourth plate 274. The fourth plate is shaped to extend along and abut top 137.2' of footing board 138.2. Fourth plate 274 is L-shaped in lateral profile in this example with a downwardly-extending peripheral portion or lip 276 shaped to promote retention of the footing board within the spacing or enclosure 278 formed by plates 142.2', 156.2' and 274. The fourth plate extends parallel to and is spaced-apart upwards from third plate 156.2. Referring to FIG. 22, fourth plate 274 couples to and extends outwards from second plate 142.2, in this example via male and female engaging members, in this case a pair of tabs 280 and 282 of the fourth plate which selectively engage with corresponding apertures 284 and 286 of the second plate. Thus, second and third plates 142.2' and 156.2' are removably coupled to base 264 of mount 136.2' and fourth plate 274 is removably coupled to the second plate of the mount.

As seen in FIGS. 21 and 22, the fourth plate includes an upwardly-extending protrusion, in this example a bent portion 288. The bent portion is centrally positioned in this example.

As seen in FIG. 22, each form support 30.2' includes an actuating or biasing member 290. The biasing member functions to promote coupling of mount 136.2' to footing board 139.1 seen in FIG. 18. The following is non-limiting embodiment of biasing member 290.

The biasing member in this example is in the form of a latch or lever. Biasing member 290 extends through apertures 292 and 294 of brace plates 140.2 and is held in place via enlarged end portions, in this example in the form of stop 296 and handle 298. The stop is closer to its corresponding brace plate 140.2A in this example compared to the handle with its corresponding brace plate 140.2. Handle is configured to be effectively cantilevered from base 264. Biasing member 290 in its actuated position is shaped to abut and hold in position fourth plate 274, inhibiting the fourth plate from being removed from second plate 142.2'. The biasing member includes a sloped bottom 300 shaped to abut against bent portion 288 via its shape and gravity. Fourth plate 274 so biased or actuated downwards as shown by arrow 302 by biasing member 290 functions to promote frictional engagement of mount 136.2' with footing board 139.2 seen in FIG. 18.

To adjust positioning of form support 30.2' and referring to FIG. 20, handle 298 of biasing member 290 may be selectively raised upwards, as shown by arrow 304. This may in turn reduce the extent to which plates 156.2 and 274 are biased against footing board 139.2 seen in FIG. 18. This thereby enables the form support to be longitudinally adjusted relative to the footing board. Biasing member 290 may thus be said to pivotally couple to mount 136.2'.

It will be appreciated that many variations are possible within the scope of the invention described herein. Where a component (e.g. a member, apparatus, assembly, device etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms. These terms ("a", "an", and "the") mean one or more unless stated otherwise;
- "and/or" is used to indicate one or both stated cases may occur, for example A and/or B includes both (A and B) and (A or B);
- "approximately" when applied to a numerical value means the numerical value±10%;
- where a feature is described as being "optional" or "optionally" present or described as being present "in some embodiments" it is intended that the present disclosure encompasses embodiments where that feature is present and other embodiments where that feature is not necessarily present and other embodiments where that feature is excluded. Further, where any combination of features is described in this application this statement is intended to serve as antecedent basis for the use of exclusive terminology such as "solely," "only" and the like in relation to the combination of features as well as the use of "negative" limitation(s)" to exclude the presence of other features; and
- "first" and "second" are used for descriptive purposes and cannot be understood as indicating or implying relative importance or indicating the number of indicated technical features.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a range for a value is stated, the stated range includes all sub-ranges of the range. It is intended that the statement of a range supports the value being at an endpoint of the range as well as at any intervening value to the tenth of the unit of the lower limit of the range, as well as any subrange or sets of sub ranges of the range unless the context clearly dictates otherwise or any portion(s) of the stated range is specifically excluded. Where the stated range includes one or both endpoints of the range, ranges excluding either or both of those included endpoints are also included in the invention.

Certain numerical values described herein are preceded by "about". In this context, "about" provides literal support for the exact numerical value that it precedes, the exact numerical value±5%, as well as all other numerical values that are near to or approximately equal to that numerical value. Unless otherwise indicated a particular numerical value is included in "about" a specifically recited numerical value where the particular numerical value provides the substantial equivalent of the specifically recited numerical value in the context in which the specifically recited numerical value is presented. For example, a statement that something has the numerical value of "about 10" is to be interpreted as: the set of statements:

in some embodiments the numerical value is 10;

in some embodiments the numerical value is in the range of 9.5 to 10.5;

and if from the context the person of ordinary skill in the art would understand that values within a certain range are substantially equivalent to 10 because the values with the range would be understood to provide substantially the same result as the value 10 then "about 10" also includes:

in some embodiments the numerical value is in the range of C to D where C and D are respectively lower and upper endpoints of the range that encompasses all of those values that provide a substantial equivalent to the value 10

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

As will be apparent to those of skill in the art upon reading this disclosure, each of the individual embodiments described and illustrated herein has discrete components and features which may be readily separated from or combined with the features of any other described embodiment(s) without departing from the scope of the present invention.

Any aspects described above in reference to apparatus may also apply to methods and vice versa.

Any recited method can be carried out in the order of events recited or in any other order which is logically possible. For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, simultaneously or at different times.

Various features are described herein as being present in "some embodiments". Such features are not mandatory and may not be present in all embodiments. Embodiments of the invention may include zero, any one or any combination of two or more of such features. All possible combinations of such features are contemplated by this disclosure even where such features are shown in different drawings and/or described in different sections or paragraphs. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible). This is the case even if features A and B are illustrated in different drawings and/or mentioned in different paragraphs, sections or sentences.

Additional Description

Examples of form supports and length-adjustable assemblies therefor have been described. The following clauses are offered as further description.

(1) A length-adjustable assembly comprising: a pair of telescoping members; an end member removably coupled to and extending radially relative to a first said telescoping member; and a male threaded member about which one or more of the telescoping members substantially extend, the male threaded member being rotatable relative to the end member with axial/longitudinal movement of the male threaded member relative to the end member being inhibited, and the male threaded member threadably coupling to a second said telescoping member.

(2) A length-adjustable assembly according to clause 1, or any preceding or subsequent clause, wherein the end member threadably couples to the first said telescoping member.

(3) A length-adjustable assembly according to any one of clauses 1 to 2, or any preceding or subsequent clause, wherein the first said telescoping member is a thread protecting sleeve.

(4) A length-adjustable assembly according to any one of clauses 1 to 3, or any preceding or subsequent clause, including a first protrusion coupled to and extending radially-outwards from the male threaded member, the first protrusion abutting and being rotatable relative to the end member.

(5) A length-adjustable assembly according to clause 4, or any preceding or subsequent clause, including a second protrusion coupled to and extending radially-outwards from the male threaded member, the second protrusion being axially spaced from the first protrusion, and the end member being positioned between the first protrusion and the second protrusion.

(6) A length-adjustable assembly according to clause 5, or any preceding or subsequent clause, wherein the second protrusion is annular.

(7) A length-adjustable assembly according to any one of clauses 5 to 6, or any preceding or subsequent clause, wherein the second protrusion is radially inwardly spaced relative to the end member.

(8) A length-adjustable assembly according to any one of clauses 5 to 7, or any preceding or subsequent clause, wherein the protrusions function as stops which abut the end member and inhibit axial/longitudinal movement of the male threaded member relative to the end member.

(9) A length-adjustable assembly according to any one of clauses 5 to 7, or any preceding or subsequent clause, wherein the first protrusion abuts the end member and inhibits axial/longitudinal movement of the male threaded member relative to the end member.

(10) A length-adjustable assembly according to any one of clauses 5 to 9, or any preceding or subsequent clause, wherein the first protrusion, the second protrusion and a portion of the male threaded member extending therebetween form an annular space within which the end member is received and is moveable relative thereto.

(11) A length-adjustable assembly according to any one of clauses 4 to 10, or any preceding or subsequent clause, wherein the first protrusion abuts and is rotatable relative to a top of the end member.

(12) A length-adjustable assembly according to any one of clauses 5 to 10, or any preceding or subsequent clause, wherein the second protrusion selectively abuts and is rotatable relative to a bottom of the end member.

(13) A length-adjustable assembly according to any one of clauses 1 to 3, or any preceding or subsequent clause, including an end portion coupled to and extending radially-outwards from the male threaded member, the end portion abutting and being rotatable relative to the end member.

(14) A length-adjustable assembly according to clause 13, or any preceding or subsequent clause, wherein the end portion is enlarged.

(15) A length-adjustable assembly according to any one of clauses 13 to 14, or any preceding or subsequent clause, wherein the end portion includes a flange which extends along the top of the end member.

(16) A length-adjustable assembly according to clause 15, or any preceding or subsequent clause, wherein the flange of the end member is annular.

(17) A length-adjustable assembly according to any one of clauses 13 to 16, or any preceding or subsequent clause, wherein the end portion couples to the male threaded member.

(18) A length-adjustable assembly according to any one of clauses 13 to 17, or any preceding or subsequent clause, wherein the end portion extends radially outwards from the male threaded member.

(19) A length-adjustable assembly according to any one of clauses 13 to 18, or any preceding or subsequent clause, wherein the end portion extends axially outwards from the male threaded member.

(20) A length-adjustable assembly according to any one of clauses 1 to 19, or any preceding or subsequent clause, wherein the male threaded member includes a drill-bit engageable end.

(21) A length-adjustable assembly according to any one of clauses 14 to 20, or any preceding or subsequent clause, wherein the end portion includes a drill-bit engageable end.

(22) A length-adjustable assembly according to any one of clauses 20 to 21, or any preceding or subsequent clause, wherein the drill-bit engageable end is a hexagonal-shaped head.

(23) A length-adjustable assembly according to any one of clauses 13 to 22, or any preceding or subsequent clause, wherein the end portion includes a body with a laterally-extending aperture extending therein.

(24) A length-adjustable assembly according to clause 23, or any preceding or subsequent clause, wherein the body of the end portion is outwardly cylindrical in shape.

(25) A length-adjustable assembly according to any one of clauses 23 to 24, or any preceding or subsequent clause, wherein the body of the end portion extends between the flange and the drill-bit engageable end.

(26) A length-adjustable assembly according to any one of clauses 23 to 25, or any preceding or subsequent clause, wherein the drill-bit engageable end is radially inwardly spaced relative to the body.

(27) A length-adjustable assembly according to any one of clauses 13 to 26, or any preceding or subsequent clause, wherein the end portion has a longitudinally-extending bore shaped to receive an upper end portion of the male threaded member.

(28) A length-adjustable assembly according to any one of clauses 13 to 27, or any preceding or subsequent clause, wherein the end portion is an end cap.

(29) A length-adjustable assembly according to any one of clauses 1 to 28, or any preceding or subsequent clause, wherein the upper end portion of the male threaded member is non-threaded and wherein the end member extends about the upper end portion of the male threaded member.

(30) A length-adjustable assembly according to any one of clauses 1 to 29, or any preceding or subsequent clause, wherein the end member couples to the first said telescoping member via reverse threading.

(31) A length-adjustable assembly according to any one of clauses 1 to 29, or any preceding or subsequent clause, wherein the male threaded member includes a first of right-hand and left-hand threading and wherein the end member couples to the first said telescoping member via a second of right-hand and left-hand threading.

(32) A length-adjustable assembly according to any one of clauses 1 to 31, or any preceding or subsequent clause, wherein the end member is T-shaped in longitudinal section.

(33) A length-adjustable assembly according to any one of clauses 1 to 32, or any preceding or subsequent clause, wherein the end member includes an inner portion and an outer portion coupled to and extending radially outwards from the inner portion thereof

(34) A length-adjustable assembly according to clause 33, or any preceding or subsequent clause, wherein the inner portion of the end member has an outer diameter substantially equal to an inner width of the first said telescoping member.

(35) A length-adjustable assembly according to any one of clauses 33 to 34, or any preceding or subsequent clause, wherein the outer portion of the end member has a width substantially equal to an outer width of the first said telescoping member.

(36) A length-adjustable assembly according to any one of clauses 33 to 35, or any preceding or subsequent clause, wherein the first said telescoping member has an upper end and wherein the outer portion of the end member is shaped to span and coupled to said upper end of the first said telescoping member.

(37) A length-adjustable assembly according to any one of clauses 33 to 36, or any preceding or subsequent clause, wherein the first said telescoping member has an upper opening and wherein the outer portion of the end member is shaped to span said upper opening.

(38) A length-adjustable assembly according to any one of clauses 33 to 37, or any preceding or subsequent clause, wherein the outer portion of the end member is polygonal in outer shape.

(39) A length-adjustable assembly according to any one of clauses 33 to 38, or any preceding or subsequent clause, wherein the outer portion of the end member is hexagonal in outer shape.

(40) A length-adjustable assembly according to any one of clauses 33 to 39, or any preceding or subsequent clause, wherein the inner portion of the end member includes threading along an exterior thereof

(41) A length-adjustable assembly according to any one of clauses 1 to 40, or any preceding or subsequent clause, including a first female threaded member coupled to the first said telescoping member and via which the end member threadably couples to the first said telescoping member.

(42) A length-adjustable assembly according to clause 41, or any preceding or subsequent clause, wherein the first female threaded member couples to the upper end of the first said telescoping member.

(43) A length-adjustable assembly according to any one of clauses 41 to 42, or any preceding or subsequent clause, wherein the first female threaded member is a nut.

(44) A length-adjustable assembly according to any one of clauses 41 to 43, or any preceding or subsequent clause, wherein the first female threaded member is welded to the upper end of the first said telescoping member.

(45) A length-adjustable assembly according to any one of clauses 41 to 44, or any preceding or subsequent clause, wherein the first female threaded member is polygonal in outer shape.

(46) A length-adjustable assembly according to any one of clauses 41 to 45, or any preceding or subsequent clause, wherein the first female threaded member is octagonal in outer shape.

(47) A length-adjustable assembly according to any one of clauses 41 to 46, or any preceding or subsequent clause, wherein the first female threaded member has a width equal to the outer width of the first said telescoping member.

(48) A length-adjustable assembly according to any one of clauses 1 to 47, or any preceding or subsequent clause, including a second female threaded member coupled to the second said telescoping member and via which the male threaded member threadably couples to the second said telescoping member.

(49) A length-adjustable assembly according to clause 48, or any preceding or subsequent clause, wherein the second female threaded member couples to an upper end of the second said telescoping member.

(50) A length-adjustable assembly according to any one of clauses 48 to 49, or any preceding or subsequent clause, wherein the second female threaded member is a nut.

(51) A length-adjustable assembly according to any one of clauses 48 to 50, or any preceding or subsequent clause, wherein the second female threaded member is welded to the upper end of the second said telescoping member.

(52) A length-adjustable assembly according to any one of clauses 48 to 51, or any preceding or subsequent clause, wherein the second female threaded member is polygonal in outer shape.

(53) A length-adjustable assembly according to any one of clauses 48 to 52, or any preceding or subsequent clause, wherein the second female threaded member is octagonal in outer shape.

(54) A length-adjustable assembly according to any one of clauses 48 to 53, or any preceding or subsequent clause, wherein the second female threaded member has a width equal to the outer width of the second said telescoping member.

(55) A length-adjustable assembly according to any one of clauses 1 to 54, or any preceding or subsequent clause, wherein the first said telescoping member comprises a tube.

(56) A length-adjustable assembly according to any one of clauses 1 to 55, or any preceding or subsequent clause, wherein the second said telescoping member comprises a tube.

(57) A length-adjustable assembly according to any one of clauses 55 to 56, or any preceding or subsequent clause, wherein each said tube is a square or rectangular in lateral section.

(58) A length-adjustable assembly according to any one of clauses 1 to 57, or any preceding or subsequent clause, including a base member coupled to the second said telescoping member.

(59) A length-adjustable assembly according to clause 58, or any preceding or subsequent clause, wherein the base member is shaped to enable the assembly to be freestanding.

(60) A length-adjustable assembly according to any one of clauses 58 to 59, or any preceding or subsequent clause, wherein the base member is planar and has at least first and second apertures extending therethrough, with the first aperture having a diameter different than that of the second aperture of the base member.

(61) A length-adjustable assembly according to any one of clauses 58 to 60, or any preceding or subsequent clause, wherein the base member comprises a first baseplate coupled to the lower end of the second said telescoping member and a second baseplate coupled to and angled relative to the first baseplate.

(62) A length-adjustable assembly according to clause 61, or any preceding or subsequent clause, wherein the first baseplate extends horizontally and wherein the second baseplate extends vertically.

(63) A length-adjustable assembly according to any one of clauses 61 to 62, or any preceding or subsequent clause, wherein the second baseplate extends perpendicular to the first baseplate.

(64) A length-adjustable assembly according to any one of clauses 61 to 63, or any preceding or subsequent clause, wherein the second baseplate has one or more apertures extending therethrough.

(65) A length-adjustable assembly according to any one of clauses 61 to 64, or any preceding or subsequent clause, wherein the second baseplate is spaced-apart from the second said telescoping member.

(66) A length-adjustable assembly according to any one of clauses 61 to 65, or any preceding or subsequent clause, wherein each said baseplate is rectangular.

(67) A length-adjustable assembly according to any one of clauses 61 to 66, or any preceding or subsequent clause, wherein the baseplates form a first L-shaped bracket.

(68) A length-adjustable assembly according to any one of clauses 1 to 57, or any preceding or subsequent clause, including a mount coupled to and extending outwards from the first said telescoping member.

(69) A length-adjustable assembly according to clause 68, or any preceding or subsequent clause, wherein the mount is adjacent the first said telescoping member.

(70) A length-adjustable assembly according to any one of clauses 68 to 69, or any preceding or subsequent clause, wherein the mount is adjacent a lower end of the first said telescoping member.

(71) A length-adjustable assembly according to any one of clauses 68 to 70, or any preceding or subsequent clause, wherein the mount extends from the lower end towards the upper end of the first said telescoping member.

(72) A length-adjustable assembly according to any one of clauses 68 to 71, or any preceding or subsequent clause, wherein the mount is shaped to selectively couple to one or more of a form member or lumber.

(73) A length-adjustable assembly according to any one of clauses 68 to 72, or any preceding or subsequent clause, wherein the mount is configured to selectively receive one or more of a form member or lumber.

(74) A length-adjustable assembly according to clause 68, or any preceding or subsequent clause, wherein the mount is positioned between the lower end and the upper end of the first said telescoping member.

(75) A length-adjustable assembly according to clause 74, or any preceding or subsequent clause, wherein the mount is positioned downwards from the upper end of the first said telescoping member so as to accommodate a brace assembly at least in part thereabove.

(76) A length-adjustable assembly according to any one of clauses 74 to 75, or any preceding or subsequent clause, wherein the mount selectively couples to a wall form.

(77) A length-adjustable assembly according to any one of clauses 74 to 76, or any preceding or subsequent clause, wherein the mount is configured to support an insulated concrete form (ICF).

(78) A length-adjustable assembly according to any one of clauses 74 to 76, or any preceding or subsequent clause, wherein the mount is configured to selectively couple to an insulated concrete form (ICF).

(79) A length-adjustable assembly according to any one of clauses 68 to 78, or any preceding or subsequent clause, wherein the mount is integrally connected to and formed with the first said telescoping member.

(80) A length-adjustable assembly according to clause 68 to 79, or any preceding or subsequent clause, wherein the mount extends outwards from a first side of the telescoping members and wherein the base member couples to the second said telescoping member, with the base member extending outwards from a second side of the telescoping members opposite the first side of the telescoping members.

(81) A length-adjustable assembly according to clause 68 to 79, or any preceding or subsequent clause, wherein the base member couples to the second said telescoping member and is shaped to counterbalance the moment caused by the mount.

(82) A length-adjustable assembly according to any one of clauses 68 to 81, or any preceding or subsequent clause, wherein the mount includes a first plate coupled to and extending outwards from the first said telescoping member and wherein the mount includes a second plate coupled to and being angled relative to the first plate thereof

(83) A length-adjustable assembly according to clause 82, or any preceding or subsequent clause, wherein the second plate of the mount extends perpendicular to the first plate of the mount.

(84) A length-adjustable assembly according to any one of clauses 82 to 83, or any preceding or subsequent clause, wherein the first plate and the second plate of the mount extend parallel to the first said telescoping member.

(85) A length-adjustable assembly according to any one of clauses 82 to 84, or any preceding or subsequent clause, wherein the first plate and the second plate of the mount extend vertically.

(86) A length-adjustable assembly according to any one of clauses 82 to 85, or any preceding or subsequent clause, wherein the second plate of the mount has one or more apertures extending therethrough via which one or more fasteners couple to one or more of a form member or lumber.

(87) A length-adjustable assembly according to any one of clauses 82 to 86, or any preceding or subsequent clause, wherein the second plate of the mount has one or more pairs laterally and longitudinally spaced apart apertures extending therethrough to receive respective fasteners.

(88) A length-adjustable assembly according to any one of clauses 82 to 87, or any preceding or subsequent clause, wherein the first plate and the second plate of the mount form a second L-shaped bracket.

(89) A length-adjustable assembly according to any one of clauses 82 to 88, or any preceding or subsequent clause, wherein the first plate and the second plate of the mount are substantially similar in size.

(90) A length-adjustable assembly according to any one of clauses 82 to 89, or any preceding or subsequent clause, wherein the mount is L-shaped in top and side profile.

(91) A length-adjustable assembly according to any one of clauses 82 to 90, or any preceding or subsequent clause, wherein the second plate of the mount is spaced-apart from the first said telescoping member.

(92) A length-adjustable assembly according to any one of clauses 82 to 88 and 91, or any preceding or subsequent clause, wherein the first plate of the mount is at least two to three times longer than the second plate of the mount.

(93) A length-adjustable assembly according to any one of clauses 82 to 90, or any preceding or subsequent clause, wherein the mount includes a third plate coupled and angled relative to the second plate thereof.

(94) A length-adjustable assembly according to clause 93, or any preceding or subsequent clause, wherein the third plate of the mount extends perpendicular to the second plate of the mount.

(95) A length-adjustable assembly according to any one of clauses 93 to 94, or any preceding or subsequent clause, wherein the third plate of the mount extends horizontally.

(96) A length-adjustable assembly according to any one of clauses 93 to 95, or any preceding or subsequent clause, wherein the first plate of the mount is orthogonal to the second plate and the third plate and wherein the second plate of the mount is orthogonal to the third plate of the mount.

(97) A length-adjustable assembly according to any one of clauses 93 to 96, or any preceding or subsequent clause, wherein the third plate of the mount aligns with and extends parallel to the lower end of the first said telescoping member.

(98) A length-adjustable assembly according to any one of clauses 93 to 97, or any preceding or subsequent clause, wherein the second plate and the third plate of the mount form a third L-shaped bracket.

(99) A length-adjustable assembly according to any one of clauses 93 to 98, or any preceding or subsequent clause, wherein the first baseplate extends parallel to the third plate of the mount.

(100) A length-adjustable assembly according to any one of clauses 93 to 99, or any preceding or subsequent clause, wherein the second baseplate extends parallel to the first plate of the mount.

(101) A length-adjustable assembly according to any one of clauses 82 to 100, or any preceding or subsequent clause, wherein each said plate is rectangular in profile.

(102) A length-adjustable assembly according to any one of clauses 82 to 101, or any preceding or subsequent clause, including a triangular plate coupled to and extending between the first plate and the first said telescoping member.

(103) A length-adjustable assembly according to clause 102, or any preceding or subsequent clause, wherein the triangular plate is integrally connected to and formed with one or more of the first plate and the first said telescoping member.

(104) A form support comprising: upper and lower telescoping members; a length-adjustable assembly actuation thereof enabling positioning of the upper telescoping member relative to the lower telescoping member to be adjusted; and a mount coupled to and extending outwards from a lower end of the upper telescoping member.

(105) A form support comprising: upper and lower telescoping members; a length-adjustable assembly actuation thereof enabling positioning of the upper telescoping member relative to the lower telescoping member to be adjusted; and a mount coupled to, extending outwards from, and being adjacent the upper telescoping member.

(106) A form support comprising: upper and lower telescoping members; a length-adjustable assembly actuation thereof enabling positioning of the upper telescoping member relative to the lower telescoping member to be adjusted; and a mount coupled to and extending outwards from the upper telescoping member, the mount being L-shaped in top and side profile.

(107) A form support comprising: upper and lower telescoping members; a length-adjustable assembly actuation thereof enabling positioning of the upper telescoping member relative to the lower telescoping member to be adjusted; and a vertically-extending L-shaped bracket coupled to and extending outwards from the upper telescoping member.

(108) A form support according to any one of clauses 104 to 107, or any preceding or subsequent clause, wherein the mount is configured to selectively receive or couple to a form member or lumber.

(109) A form support comprising: upper and lower telescoping members; a length-adjustable assembly actuation thereof enabling positioning of the upper telescoping member relative to the lower telescoping member to be adjusted; and a mount coupled to and extending outwards from the upper telescoping member between a lower end and an upper end of the upper telescoping member.

(110) A form support according to clause 109, or any preceding or subsequent clause, wherein the mount is configured to selectively receive or couple to a wall form.

(111) A form support according to any one of clauses 109 to 110, or any preceding or subsequent clause, wherein the form support is an insulated concrete form (ICF) support.

(112) A form support according to any one of clauses 104 to 111, or any preceding or subsequent clause, wherein the mount is integrally connected to the upper telescoping member so as to form a unitary whole.

(113) A form support comprising: upper and lower telescoping members; a length-adjustable assembly actuation thereof enabling positioning of the upper telescoping member relative to the lower telescoping member to be adjusted; a mount coupled to and extending outwards from the upper telescoping member; and a baseplate coupled to the lower telescoping member, the baseplate having a plurality of apertures extending therethrough of different diameters.

(114) A form support comprising: upper and lower telescoping members; a length-adjustable assembly actuation thereof enabling positioning of the upper telescoping member relative to the lower telescoping member to be adjusted; a first L-shaped bracket coupled to and extending outwards from the upper telescoping member; and a second L-shaped bracket coupled to a lower end of the lower telescoping member.

(115) A form assembly comprising the length-adjustable assembly of any one of clauses 1 to 103, or any preceding or subsequent clause.

(116) A form assembly comprising the form support of any one of clauses 104 to 114, or any preceding or subsequent clause.

(117) Apparatus including any new and inventive feature, combination of features, or sub-combination of features as described herein.

(118) Methods including any new and inventive steps, acts, combination of steps and/or acts or sub-combination of steps and/or acts as described herein.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A length-adjustable assembly for a form support connectable to a form, the length-adjustable assembly comprising:

a pair of telescoping members;

an end member including an inner portion and an outer portion coupled to and extending radially outwards from the inner portion thereof, the inner portion of the end member removably coupling to and extending radially relative to a first one of the pair of telescoping members, and the outer portion of the end member being shaped to at least span an upper opening of and being positioned above the first one of the pair of telescoping members; and a male threaded member about which one or more of the pair of telescoping members substantially extend, the male threaded member operatively connecting to a second one of the telescoping members, the male threaded member being rotatable relative to the end member with axial movement of the male threaded member relative to the end member being inhibited, wherein the pair of telescoping members are moveable towards an extended position by rotating the male threaded member in a first direction of rotation, and wherein rotating the end member in the first direction of rotation promotes coupling of the end member with the first one of the pair of telescoping members.

2. The length-adjustable assembly according to claim 1, including a pair of longitudinally spaced-apart and radially-extending protrusions between which the end member is positioned, the protrusions being shaped to enable rotation of the male threaded member relative to the end member while inhibiting axial movement of the male threaded member relative to the end member.

3. The length-adjustable assembly according to claim 2, wherein a first one of the protrusions is an annular member coupled to an upper end portion of the male threaded member, and wherein a second one of the protrusions is an end cap coupled to an upper end of the male threaded member and via which the male threaded member is manually rotatable.

4. The length-adjustable assembly according to claim 1, including a female threaded member coupled to or a part of the first one of the pair of telescoping members and via which the end member threadably couples to the first one of the pair of telescoping members, and wherein the female threaded member has a width generally or substantially equal to an outer width of the first one of the pair of telescoping members.

5. A form support comprising the length-adjustable assembly according to claim 1 and a mount coupled to, integrally formed with and extending outwards from the first one of the pair of telescoping members of the length-adjustable assembly, the mount being shaped to selectively couple to or support a form member.

6. The length-adjustable assembly according to claim 1, wherein the pair of telescoping members are moveable towards a retracted position to lower the form by rotating the male threaded member in a second direction of rotation opposite the first direction of rotation, and wherein the male threaded member is removable from the pair of telescoping members by rotating the end member in the second direction of rotation.

7. The length-adjustable assembly according to claim 1, wherein the inner portion of the end member has reverse threading along an outer surface thereof and via which the inner portion of the end member threadably couples to the first one of the pair of telescoping members.

8. The length-adjustable assembly according to claim 1, wherein the end member is rotatable via the outer portion thereof, wherein the outer portion of the end member is polygonal in outer shape, and wherein the male threaded member includes an upper end positioned axially upwards from the end member and the pair of telescoping members, to enable rotation thereof.

9. The length adjustable assembly according to claim 8, including an end cap coupled to the upper end portion of the male threaded member and via which the male threaded member is manually rotatable, with the end cap having a polygonal-shaped head.

10. The length-adjustable assembly according to claim 1, wherein the end member has a bore extending longitudinally therethrough and wherein the male threaded member extends through and substantially spans the bore of the end member.

11. The length-adjustable assembly according to claim 1, wherein the threading of the end member is radially-inwardly facing and wherein the threading of the male threaded member is radially outwardly facing.

12. The length-adjustable assembly according to claim 1, including a first, horizontally-extending baseplate coupled to the lower end of the second one of the pair of telescoping members, the first baseplate having one or more apertures to receive one or more stakes therethrough, and including a second, vertically-extending baseplate laterally spaced from the second one of the pair of telescoping members, the second baseplate coupling to and extending upwards relative to the first baseplate, with the second baseplate having one or more apertures to receive one or more additional stakes therethrough.

13. The length-adjustable assembly according to claim 1, including a pair of axially spaced-apart nuts each welded to an upper end of a respective one of the pair of telescoping members, with the inner portion of the end member threadably coupling to a first one of the pair of nuts and with the male threaded member threadably coupling to a second one of the pair of nuts.

14. A form support comprising the length-adjustable assembly according to claim 1, a mount coupled to and extending outwards from the first one of the pair of telescoping members of the length-adjustable assembly, and one or more of:

i) the mount comprises a plurality of plates that are removably coupled together, or ii) the form support includes a biasing member configured to promote coupling of the mount to a footing board and/or lumber, with actuation of the biasing member enabling the mount to be selectively longitudinally adjustable relative to the footing form and/or lumber.

15. A form assembly comprising:

a pair of longitudinally-extending, laterally spaced and coupled together wall forms;

a pair of form supports, each said form support including the length-adjustable assembly according to claim 1 and including a mount coupled to and extending outwards from the first one of the pair of telescoping members of the length-adjustable assembly, the mounts being shaped to selectively couple to respective said wall forms; and a longitudinally-extending fabric element, with peripheral portions of the fabric element being shaped to couple to the wall forms so as to form an upwardly-facing channel below the wall forms and within which concrete is receivable, the fabric element extending between the form supports so as to enable the form supports to be selectively removable upon the concrete setting.

16. A method of forming the length-adjustable assembly of claim 1, the method comprising:

positioning the end member such that a top thereof abuts or is adjacent to a first protrusion, the first protrusion coupling to or being a part of the male threaded member;

positioning a second protrusion adjacent or below a bottom of the end member such that the end member is rotatable relative to the protrusions; and coupling the second protrusion to one of the male threaded member and the first one of the pair of telescoping members.

17. A method of forming the form support of claim 5, the method comprising:

bending a first longitudinal portion of a blank about itself to form the first one of the pair of telescoping members; and shaping a second longitudinal portion of the blank so as to form said mount, with the mount extending outwards from the first one of the pair of telescoping members and being angled at least in part.

18. The form support according to claim 5, wherein the mount includes a first plate coupled to and extending outwards from the first one of the pair of telescoping members, wherein the mount includes a second plate coupled to and angled relative to the first plate thereof, and wherein one or more of:

i) the first plate and the second plate of the mount extend parallel to the first one of the pair of telescoping members, ii) the first plate and the second plate of the mount extend vertically, iii) the second plate of the mount is spaced-apart from the first one of the pair of telescoping members, or iv) the second plate of the mount has one or more apertures extending therethrough via which one or more fasteners couple to one or more of a footing board and/or lumber.

19. The form support according to claim 5, wherein the mount includes a first plate coupled to and extending outwards from the first one of the pair of telescoping members, a second plate coupled to and angled relative to the first plate thereof, and a third plate coupled to and angled relative to the second plate thereof, and wherein one or more of:

i) the mount is L-shaped in top and side profile, ii) the third plate of the mount extends perpendicular to the second plate of the mount, iii) the third plate of the mount extends horizontally, iv) the third plate of the mount aligns with and extends parallel to a lower end of the first one of the pair of telescoping members, v) the first plate and the second plate of the mount form a first said L-shaped bracket, or vi) the second plate and the third plate of the mount form a second said L-shaped bracket.

20. A length-adjustable assembly for a form support connectable to a form, the length-adjustable assembly comprising:

a pair of telescoping members;

an end member removably coupled to and extending radially relative to a first one of the pair of telescoping members; and a male threaded member about which one or more of the pair of telescoping members substantially extend, the male threaded member being rotatable relative to the end member with axial movement of the male threaded member relative to the end member being inhibited;

wherein the end member threadably couples to a first one of the pair of telescoping members via one of right-hand and left-hand threading, wherein the male threaded member threadably couples to a second one of the pair of telescoping members via the other of right-hand and left-hand threading, wherein the pair of telescoping members are moveable towards an extended position to lift the form by rotating the male threaded member in a first direction of rotation, and wherein rotating the end member in the first direction of rotation promotes coupling of the end member with the first one of the pair of telescoping members.

* * * * *